US007216514B2

(12) United States Patent
Sakita et al.

(10) Patent No.: US 7,216,514 B2
(45) Date of Patent: May 15, 2007

(54) CLOTH WASHER, DISH WASHER-DRYER, AND CONTROL SYSTEM OF THE SAME

(75) Inventors: Yoshiaki Sakita, Osaka (JP); Shoichi Matsui, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 657 days.

(21) Appl. No.: 10/655,360

(22) Filed: Sep. 4, 2003

(65) Prior Publication Data

US 2004/0089029 A1 May 13, 2004

(30) Foreign Application Priority Data

Sep. 11, 2002 (JP) ..... 2002-266092

(51) Int. Cl.

| | |
|---|---|
| ***D06F 33/00*** | (2006.01) |
| ***D06F 37/00*** | (2006.01) |
| ***B08B 3/12*** | (2006.01) |
| ***G05B 11/01*** | (2006.01) |
| ***G05B 19/42*** | (2006.01) |

(52) U.S. Cl. ..... 68/12.12; 68/3 R; 68/12.02; 700/18; 700/23; 700/87; 700/88; 134/56 D; 134/57 D; 134/58 D; 134/95.1

(58) Field of Classification Search ..... 700/1, 700/11, 12, 17, 18, 23, 27, 83, 86–90; 68/12.01, 68/12.02, 12.05, 12.07, 12.12, 12.23, 12.27; 134/56–58, 18, 95.1

See application file for complete search history.

(56) References Cited

U.S. PATENT DOCUMENTS

| | | | | |
|---|---|---|---|---|
| 4,195,498 | A * | 4/1980 | Pellerin | 68/3 R |
| 4,318,084 | A * | 3/1982 | Scott et al. | 340/309.8 |
| 6,983,628 | B2 * | 1/2006 | Cho | 68/12.01 |
| 2002/0040505 | A1 * | 4/2002 | Tanaka et al. | 8/158 |
| 2002/0087351 | A1 * | 7/2002 | Jo | 705/1 |
| 2002/0128729 | A1 * | 9/2002 | Blair et al. | 700/19 |
| 2003/0115682 | A1 * | 6/2003 | Gardner | 8/159 |

FOREIGN PATENT DOCUMENTS

| | | |
|---|---|---|
| JP | 2002-119788 | 4/2002 |
| KR | 2000-10514 | 2/2000 |
| KR | 2002-56399 | 7/2002 |

* cited by examiner

*Primary Examiner*—Crystal J. Barnes
(74) *Attorney, Agent, or Firm*—RatnerPrestia

(57) ABSTRACT

The invention provides a cloth washer, a dish washer-dryer and a control system associated therewith, which facilitate establishing of a special operating program. The cloth washer comprises selector means for selecting one of a plurality of basic operating programs, which are individually preprogrammed with specifications of washing operation, rinsing operation and spin-dry operation, special operating program setting means for establishing a special operating program by correcting at least one of the specifications of the washing operation, the rinsing operation and the spin-dry operation preprogrammed for the one selected by the selector means among the plurality of basic operating programs, and control means for controlling the washing operation, the rinsing operation and the spin-dry operation according to the special operating program set by the special operating program setting means.

20 Claims, 23 Drawing Sheets

FIG. 5

| Programs | Wash time | Rinse cycle | Spin-dry time | Swirling water | Spin-dry rotation |
|---|---|---|---|---|---|
| Regular program | 9 minutes | With supplying water 2 | 7 minutes | standard | High speed |
| Soak wash | 59 minutes | With supplying water 2 | 7 minutes | standard | High speed |
| Detergent saving | 9 minutes | With impounded water 2 | 7 minutes | standard | High speed |
| Heavy-duty | 12 minutes | With impounded water 2 | 7 minutes | strong | High speed |
| Short | 3 minutes | With supplying water 1 | 3 minutes | standard | High speed |
| Shirt washing | 6 minutes | With supplying water 1 | 12 minutes | standard | High speed |
| In-home cleaning | 12 minutes | With impounded water 2 | 40 seconds | weak | Low speed |
| Blanket washing | 15 minutes | With supplying water 2 | 7 minutes | weak | High speed |

CLOTH WASHER, DISH WASHER-DRYER, AND CONTROL SYSTEM OF THE SAME

FIELD OF THE INVENTION

The present invention relates to a cloth washer and a dish washer-dryer which perform washing operation, rinsing operation and drying operation according to a special operating program established by correction made on a basic operating program having preprogrammed specifications for washing operation, rinsing operation and drying operation. The invention also relates to a control system for the cloth washer and the dish washer-dryer.

BACKGROUND OF THE INVENTION

With reference to FIG. 21 through FIG. 23, description is provided on a conventional washing machine which performs washing operation, rinsing operation and spin-dry operation according to a special operating program established by correction made on a basic operating program having preprogrammed specifications for the washing operation, the rinsing operation and the spin-dry operation.

FIG. 21 is a vertically sectioned side view depicting a structure of conventional cloth washer 390, FIG. 22 is a circuit block diagram showing the structure of conventional cloth washer 390, and FIG. 23 is a front view depicting an exterior of control panel 398 equipped in conventional cloth washer 390.

Cloth washer 390 is provided with enclosure 325 having generally a rectangular parallelepiped shape. Enclosure 325 has water receiving tub 321 of generally a cylindrical shape disposed to the inside thereof. Water receiving tub 321 is suspended on enclosure 325 with suspension rods 324. Water receiving tub 321 is provided in it with washing-cum-drying basket 322 of generally a cylindrical shape. In the bottom of washing-cum-drying basket 322, pulsator 323 is attached to a vertically mounted shaft in a freely rotatable manner.

Water receiving tub 321 is provided with motor 327 for driving pulsator 323. Motor 327 consists of a brushless D.C. motor. Power shifting mechanism 326 is arranged between motor 327 and pulsator 323. Power shifting mechanism 326 decelerates a driving force of motor 327 and transmits it to pulsator 323 during a washing cycle, but transmits the driving force of motor 327 directly in one-to-one ratio to pulsator 323 and washing-cum-drying basket 322 during a spin-dry cycle.

Water receiving tub 321 has cover 328 on top of it to constitute a discharge port for water splay. Water supply valve 331 is installed above water receiving tub 321. Water supply valve 331 is provided for supplying water to washing-cum-drying basket 322. Drain valve 332 is installed beneath water receiving tub 321. Drain valve 332 is provided for draining the washing water from water receiving tub 321.

Water receiving tub 321 has connecting port 330 at a lower part of it. Water receiving tub 321 also has water level detector 329. Water level detector 329 converts a water pressure at connecting port 330 into an electrical frequency for detecting a level of the water inside water receiving tub 321.

Motor 327 is driven by inverter circuit 337. Inverter circuit 337 has six switching elements 338A to 338F. Each of switching elements 338A to 338F has a parallel circuit comprising a power transistor and a diode.

Cloth washer 390 has power supply 340. Power supply 340 delivers a voltage to inverter circuit 337 via a D.C. power converter comprised of diode bridge 341, choke coil 342 and smoothing capacitor 343. Power supply 340 also supplies the voltage to a pump, which is not shown in the figure, to water supply valve 331, drain valve 332 and power shifting mechanism 326. Motor 327 is provided with three position detectors 335. Each of position detectors 335 detects a rotating position of motor 327.

Cloth washer 390 is provided with control unit 303. Control unit 303 has rotation controller 334. Rotation controller 334 controls driving circuit 336 based on the rotating position of motor 327 detected by each of position detectors 335 and the water level in water receiving tub 321 detected by water level detector 329. Driving circuit 336 drives inverter circuit 337 according to a direction provided by rotation controller 334.

The pump, which is not shown in the figure, water supply valve 331, drain valve 332 and power shifting mechanism 326 are connected to component drive unit 333. Component drive unit 333 drives the pump, not shown in the figure, water supply valve 331, drain valve 332 and power shifting mechanism 326 respectively according to a direction provided by control unit 303.

Cloth washer 390 is provided with control panel 398. Control panel 398 has operating program selector button 304J for selecting any one of a plurality of basic operating programs and a special operating program, and a plurality of operating program selection lamps 304D corresponding respectively to the plurality of basic operating programs and the special operating program. Each of operating program selection lamps 304D comprises an LED. The basic operating programs include "regular program", "short program" and "in-home cleaning program", for instance. The "regular program" represents the most standard operating program, in which a washing time is set for "9 minutes", a number of rinse cycles for "2 times with supplying water", and a spin-dry time for "7 minutes", for example. The "short program" is a basic operating program designed to complete the washing in a hurry, and it has a washing time set for "3 minutes", a number of rinse cycles for "once with supplying water", and a spin-dry time for "3 minutes", for example. The "in-home cleaning program" is another basic operating program designed for the "dry-cleaning" items using the cloth washer for household use, and it has a washing time set for "12 minutes", a number of rinse cycles for "2 times with impounded water", and a spin-dry time for "40 seconds", for example. The "special operating program" is so designed that a washing time for the washing operation, a number of rinse cycles for the rinsing operation, and a spin-dry time for the spin-dry operation can be set arbitrarily. Operating program selection lamp 304D is provided for each of the "regular program", the "short program", the "in-home cleaning program", and the "special operating program". These operating program selection lamps 304D light up alternately from the "regular program", "short program", "in-home cleaning program" and "special operating program" in this sequential order, at each time operating program selector button 304J is pressed.

Control panel 398 has input unit 304 for entering a washing time for the washing operation, a number of rinse cycles for the rinsing operation and a spin-dry time for the spin-dry operation, and display section 305 for displaying the washing time, the number of rinse cycles and the spin-dry time entered from input unit 304. Input unit 304 comprises a plurality of buttons for setting the washing time, the number of rinse cycles and the spin-dry time respectively.

Control panel 398 also has special operating program setting unit 302. Special operating program setting unit 302 establishes a "special operating program" by correcting the washing time, the number of rinse cycles and the spin-dry time as originally preprogrammed for the "regular program", which represent the most standard operating program, with the washing time, the number of rinse cycles and the spin-dry time respectively entered from input unit 304.

In cloth washer 390 constructed as above, when a user selects the "special operating program" by pressing operating program selector button 304J, display section 305 displays in it the washing time, the number of rinse cycles, and the spin-dry time preprogrammed for the "regular program", which is the most standard operating program. The user then enters a desired washing time, a number of rinse cycles and a spin-dry time by pressing individual buttons comprising input unit 304 while referring to the washing time, the number of rinse cycles and the spin-dry time of the "regular program" displayed in display section 305, in an effort to make corrections for the washing time, the number of rinse cycles and the spin-dry time of the "regular program".

Next, special operating program setting unit 302 establishes the special operating program by correcting the originally preprogrammed washing time, the number of rinse cycles and the spin-dry time for the "regular program", according to the washing time, the number of rinse cycles and the spin-dry time as desired and entered therein by the user.

Thereafter, control unit 303 controls driving circuit 336 and component drive unit 333 in a manner to carry out the washing operation, the rinsing operation and the spin-dry operation according to the washing time, the number of rinse cycles and the spin-dry time set by special operating program setting unit 302.

The structure described above and relevant techniques are disclosed in Japanese Patent Unexamined Publication, No. 2002-119788.

In the above-described structure of the conventional cloth washer 390, the user establishes the special operating program while referring to the washing time of "9 minutes", the number of rinse cycles of "2 times with supplying water" and the spin-dry time of "7 minutes" preprogrammed for the "regular program" representing the most standard operating program. Therefore, even when the user desires to establish the special operating program by making minor changes, for example, on the "short program" representing the basic operating program designed to complete the washing in a hurry, and consisting of the washing time for "3 minutes", the number of rinse cycles for "once with supplying water" and the spin-dry time for "3 minutes", all the user can refer is the "regular program" providing "9 minutes" of the washing time, "2 times with supplying water" for the number of rinse cycles and "3 minutes" of the spin-dry time, when setting user's desired washing time, number of rinse cycles and spin-dry time. In this instance, it is difficult for the user to know how the washing time, the number of rinse cycles and the spin-dry time are best set for the purpose. Accordingly, it has a problem that the user is required to review every detail of operation of the special operating program from the ground up and to determine the desired washing time, number of rinse cycles and spin-dry time before setting them.

SUMMARY OF THE INVENTION

A cloth washer comprises selector means for selecting one of basic operating programs, special operating program setting means for establishing a special operating program by correcting at least one of specifications of washing operation, rinsing operation and spin-dry operation preprogrammed for the selected one of the basic operating programs, and control means for controlling the washing operation, the rinsing operation and the spin-dry operation according to the special operating program.

A control system comprises a cloth washer and a first terminal for controlling the cloth washer, wherein the first terminal has selector means for selecting one of basic operating programs to be performed by the cloth washer, special operating program setting means for establishing a special operating program by correcting at least one of specifications of washing operation, rinsing operation and spin-dry operation preprogrammed for the selected one of the basic operating programs, and transmitter means for transmitting information that represents specifications of the special operating program, and further wherein the cloth washer has receiver means for receiving the information representing the specifications of the special operating program transmitted by the transmitter means, and control means for controlling the washing operation, the rinsing operation and the spin-dry operation according to the information representing the specifications of the special operating program.

A dish washer-dryer comprises selector means for selecting one of basic operating programs, special operating program setting means for establishing a special operating program by correcting at least one of specifications of washing operation, rinsing operation and drying operation preprogrammed for the selected one of the basic operating programs, and control means for controlling the washing operation, the rinsing operation and the drying operation according to the special operating program.

Another control system comprises a dish washer-dryer and a second terminal for controlling the dish washer-dryer, wherein the second terminal has selector means for selecting one of basic operating programs, special operating program setting means for establishing a special operating program by correcting at least one of specifications of washing operation, rinsing operation and drying operation preprogrammed for the selected one of the basic operating programs, and transmitter means for transmitting information that represents specifications of the special operating program, and further wherein the dish washer-dryer has receiver means for receiving the information representing the specifications of the special operating program transmitted by the transmitter means provided in the second terminal, and control means for controlling the washing operation, the rinsing operation and the drying operation according to the information representing the specifications of the special operating program received by the receiver means.

BRIEF DESCRIPTION OF THE DRAWINGS

FIG. 5 is a table detailing specifications of washing operations, rinsing operations and spin-dry operations preprogrammed individually for a plurality of basic operating programs of the cloth washer according to the first exemplary embodiment.

DETAILED DESCRIPTION OF THE EXEMPLARY EMBODIMENTS

The present invention addresses the above described problems of the prior art, and an object of the invention is to provide a cloth washer, a dish washer-dryer and a control system that facilitate setting of a special operation program.

Exemplary embodiments of the present invention will be described hereinafter with reference to the accompanying drawings.

(First Exemplary Embodiment)

Figure 1:
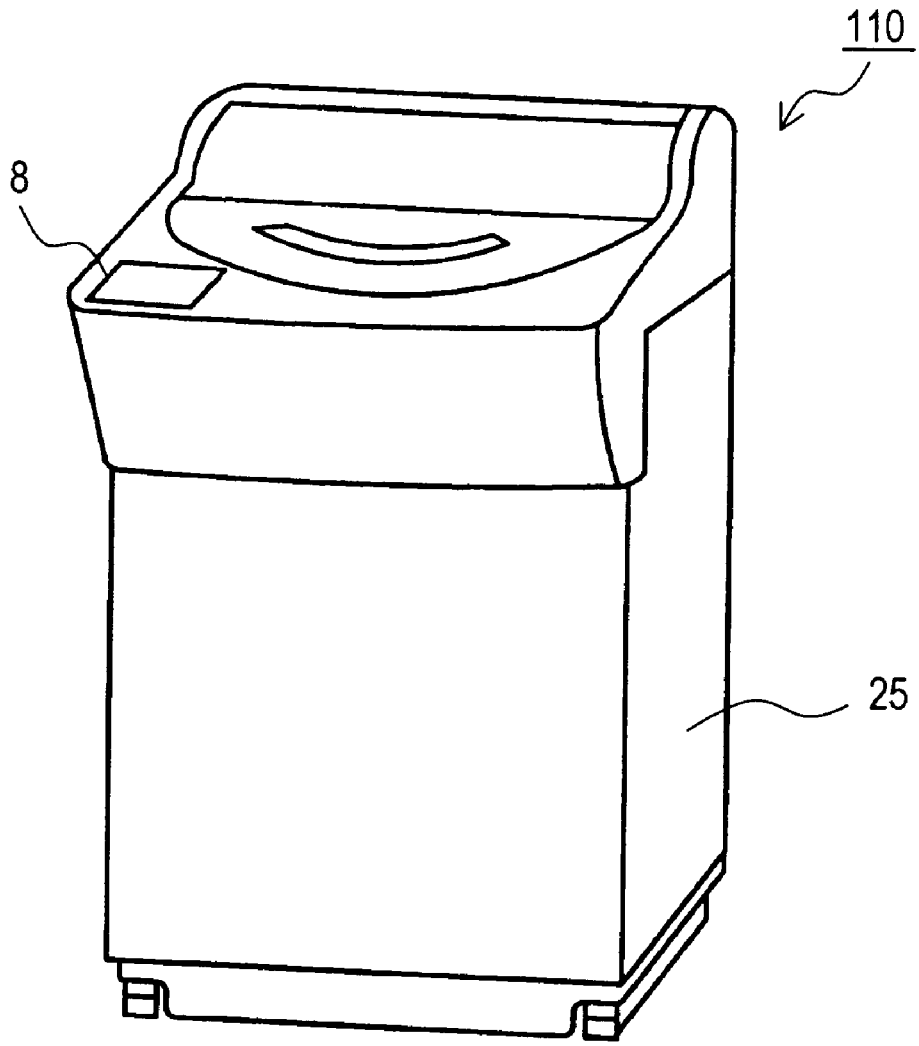
FIG. 1 is a perspective view depicting an exterior of a cloth washer according to a first exemplary embodiment.
Figure 2:
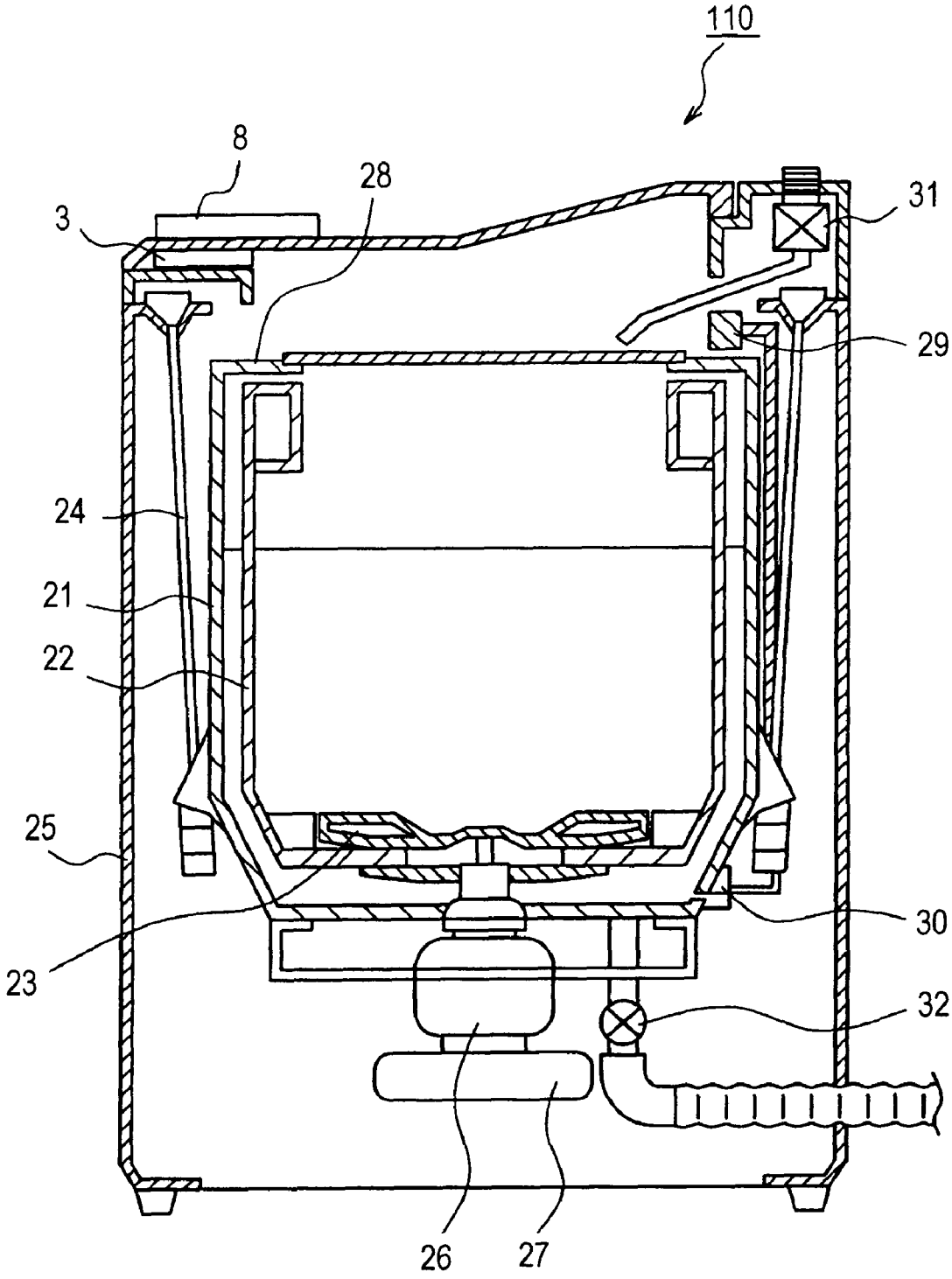
FIG. 2 is a sectioned side view depicting a structure of the cloth washer according to the first exemplary embodiment.
Figure 3:
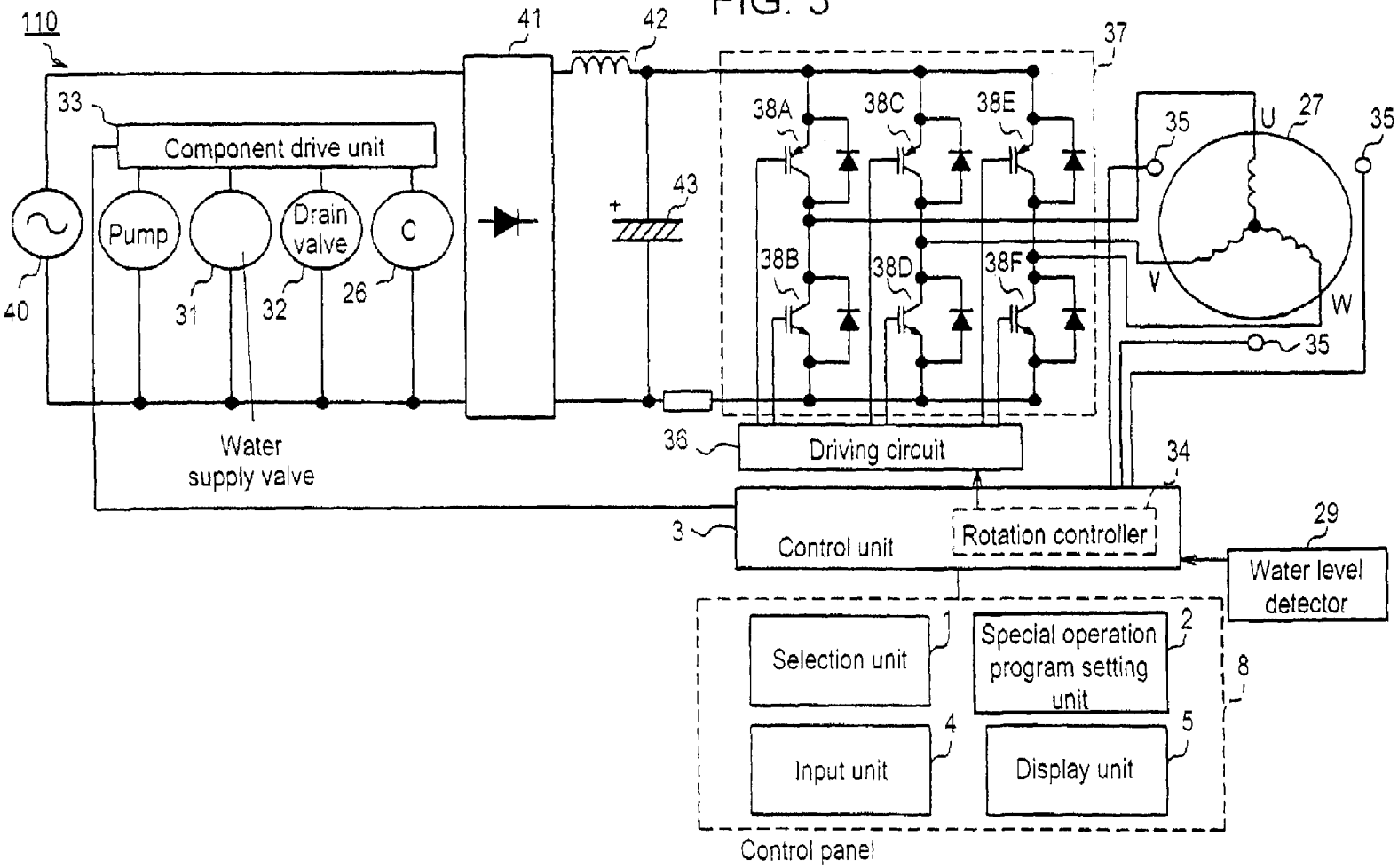
FIG. 3 is a circuit block diagram depicting the structure of the cloth washer according to the first exemplary embodiment.

FIG. 1 is a perspective view depicting an exterior of cloth washer 110 according to the first exemplary embodiment, FIG. 2 is a sectioned side view depicting a structure of cloth washer 110, and FIG. 3 is a circuit block diagram depicting the structure of cloth washer 110.

Cloth washer 110 is provided with enclosure 25 having generally a rectangular parallelepiped shape. Enclosure 25 has water receiving tub 21 of generally a cylindrical shape disposed to the inside thereof.

Water receiving tub 21 is suspended on enclosure 25 with suspension rods 24. Water receiving tub 21 is provided in it with washing-cum-drying basket 22 of generally a cylindrical shape. In the bottom of washing-cum-drying basket 22, pulsator 23 is attached to a vertically mounted shaft in a freely rotatable manner. Water receiving tub 21 houses motor 27 for driving pulsator 23. Motor 27 is comprised of a brushless D.C. motor. Power shifting mechanism 26 is arranged between motor 27 and pulsator 23. Power shifting mechanism 26 decelerates a driving force of motor 27 and transmits it to pulsator 23 during a washing cycle, but transmits the driving force of motor 27 directly in one-to-one ratio to pulsator 23 and washing-cum-drying basket 22 during a spin-dry cycle.

Water receiving tub 21 has cover 28 on top of it to constitute a discharge port for water splay. Water supply valve 31 is installed above water receiving tub 21. Water supply valve 31 is provided for supplying water to washing-cum-drying basket 22. Drain valve 32 is mounted beneath water receiving tub 21. Drain valve 32 is provided for draining the washing water from water receiving tub 21.

Water receiving tub 21 has connecting port 30 at a lower part of it. Water receiving tub 21 also has water level detector 29. Water level detector 29 converts a water pressure at connecting port 30 into an electrical frequency for detecting a level of water inside water receiving tub 21.

Motor 27 is driven by inverter circuit 37. Inverter circuit 37 has six switching elements 38A to 38F. Each of switching elements 38A to 38F has a parallel circuit comprising a power transistor and a diode.

Cloth washer 110 has power supply 40. Power supply 40 supplies a voltage to inverter circuit 37 via a D.C. power converter comprised of diode bridge 41, choke coil 42 and smoothing capacitor 43. Power supply 40 also supplies the voltage to a pump, which is not shown in the figure, water supply valve 31, drain valve 32 and power shifting mechanism 26. Motor 27 is provided with three position detectors 35. Each of position detectors 35 detects a rotating position of motor 27.

Cloth washer 110 is provided with control unit 3. Control unit 3 has rotation controller 34. Rotation controller 34 controls driving circuit 36 based on the rotating position of motor 27 detected by each of position detectors 35 and the water level in water receiving tub 21 detected by water level detector 29. Driving circuit 36 drives inverter circuit 37 according to a direction provided by rotation controller 34.

The pump, which is not shown in the figure, water supply valve 31., drain valve 32 and power shifting mechanism 26 are connected to component drive unit 33. Component drive unit 33 drives the pump, not shown in the figure, water supply valve 31, drain valve 32 and power shifting mechanism 26 respectively according to a direction provided by control unit 3.

Figure 4A:
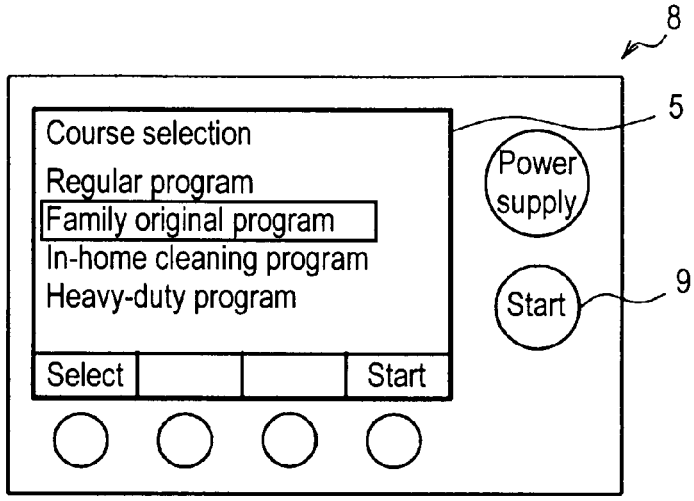
FIG. 4A is a front view of a control panel provided in the cloth washer according to the first exemplary embodiment.

Cloth washer 110 is provided with control panel 8. FIG. 4A is a front view of control panel 8 disposed to the cloth washer of the first exemplary embodiment. Control panel 8 has display unit 5 as is referred to in FIG. 4A and FIG. 3. Display unit 5 is composed of a liquid crystal display. Display unit 5 displays some of a plurality of basic operating programs as well as a special operating program. In an example depicted in FIG. 4A, the plurality of basic operating programs are "regular program", "in-home cleaning program" and "heavy duty program", and the special operating program is "family original program". In the "family original program", a washing time for washing operation, a number of rinse cycles for rinsing operation, and a spin-dry time for spin-dry operation can be set arbitrarily in a way suitable for individual family.

FIG. 5 is a table detailing specifications of washing operations, rinsing operations and spin-dry operations preprogrammed individually for the plurality of basic operating programs. There are 8 kinds of the basic operating programs provided for cloth washer 110, as shown in FIG. 5, and specifications preprogrammed for each of the basic operating programs include a washing time for the washing operation, a number of rinse cycles for the rinsing operation, a spin-dry time for the spin-dry operation, a strength of swirling water in the washing and rinsing operations, and a spinning speed for the spin-dry operation.

In the example shown in FIG. 5, the "regular program" representing the most standard operating program includes specifications in which a washing time is set for 9 minutes, a number of rinse cycles for 2 times with supplying water, a spin-dry time for 7 minutes, swirling water to a standard level, and spin-dry rotation to a high speed. In a "soak-wash program" for washing by soaking out clothes, the washing time is set for 59 minutes, the number of rinse cycles for 2 times with supplying water, the spin-dry time for 7 minutes, the swirling water to a standard level, and spin-dry rotation to a high speed. In a "detergent saving program" for washing with ½ an amount of detergent, the washing time is set for 9 minutes, the number of rinse cycles for 2 times with impounded water, the spin-dry time for 7 minutes, the swirling water to a standard level, and the spin-dry rotation to a high speed. In a "heavy-duty program" for washing clothes roughly, the washing time is set for 12 minutes, the number of rinse cycles for 2 times with impounded water, the spin-dry time for 7 minutes, the swirling water to a strong level, and the spin-dry rotation to a high speed.

In a "short program" for completing the washing in a hurry, the washing time is set for 3 minutes, the number of rinse cycles for once with supplying water, the spin-dry time for 3 minutes, the swirling water to a standard level, and the spin-dry rotation to a high speed. In a "shirt washing program" for washing shirts, the washing time is set for 6 minutes, the number of rinse cycles for once with supplying water, the spin-dry time for 12 minutes, the swirling water to a standard level, and the spin-dry rotation to a high speed. In an "in-home cleaning program" for washing domestically such clothes that are recommended for dry cleaning, the washing time is set for 12 minutes, the number of rinse cycles for 2 times with impounded water, the spin-dry time for 40 seconds, the swirling water to a weak level, and the spin-dry rotation to a low speed. In a "blanket washing program" for washing blankets, the washing time is set for 15 minutes, the number of rinse cycles for 2 times with supplying water, the spin-dry time for 7 minutes, the swirling water to a weak level, and the spin-dry rotation to a high speed.

Referring back to FIG. 4A again, control panel 8 is provided with a touch-sensitive panel over display unit 5. The user can select any of the "regular program", the "family original program", the "in-home cleaning program" and the "heavy-duty program" displayed in display unit 5 by simply touching the touch-sensitive panel.

Figure 4B:
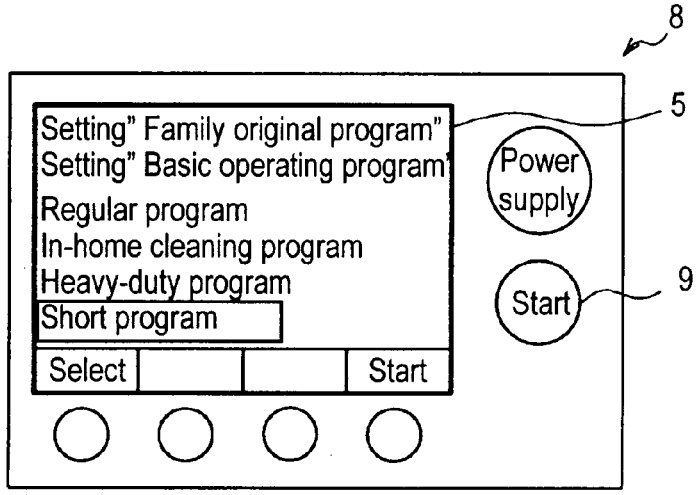
FIG. 4B is another view of the control panel provided in the cloth washer of the first exemplary embodiment, illustrating a procedure of selecting one of a plurality of basic operating programs.
Figure 4C:
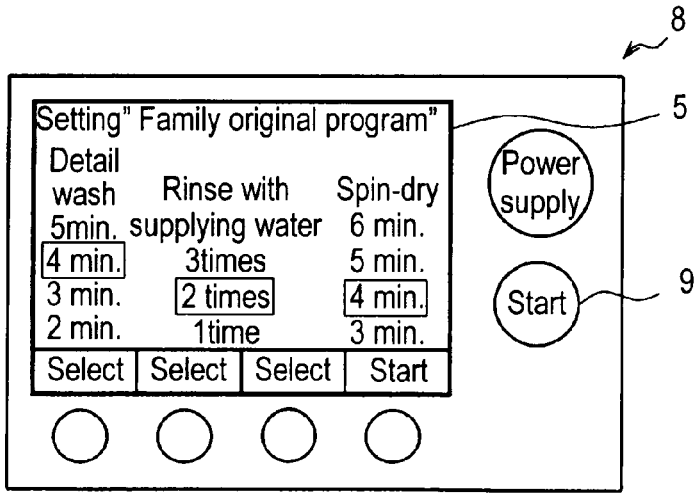
FIG. 4C is still another view of the control panel provided in the cloth washer of the first exemplary embodiment, illustrating a procedure of correcting specifications of washing operation, rinsing operation and spin-dry operation preprogrammed for the selected one of the basic operating programs.
Figure 6:
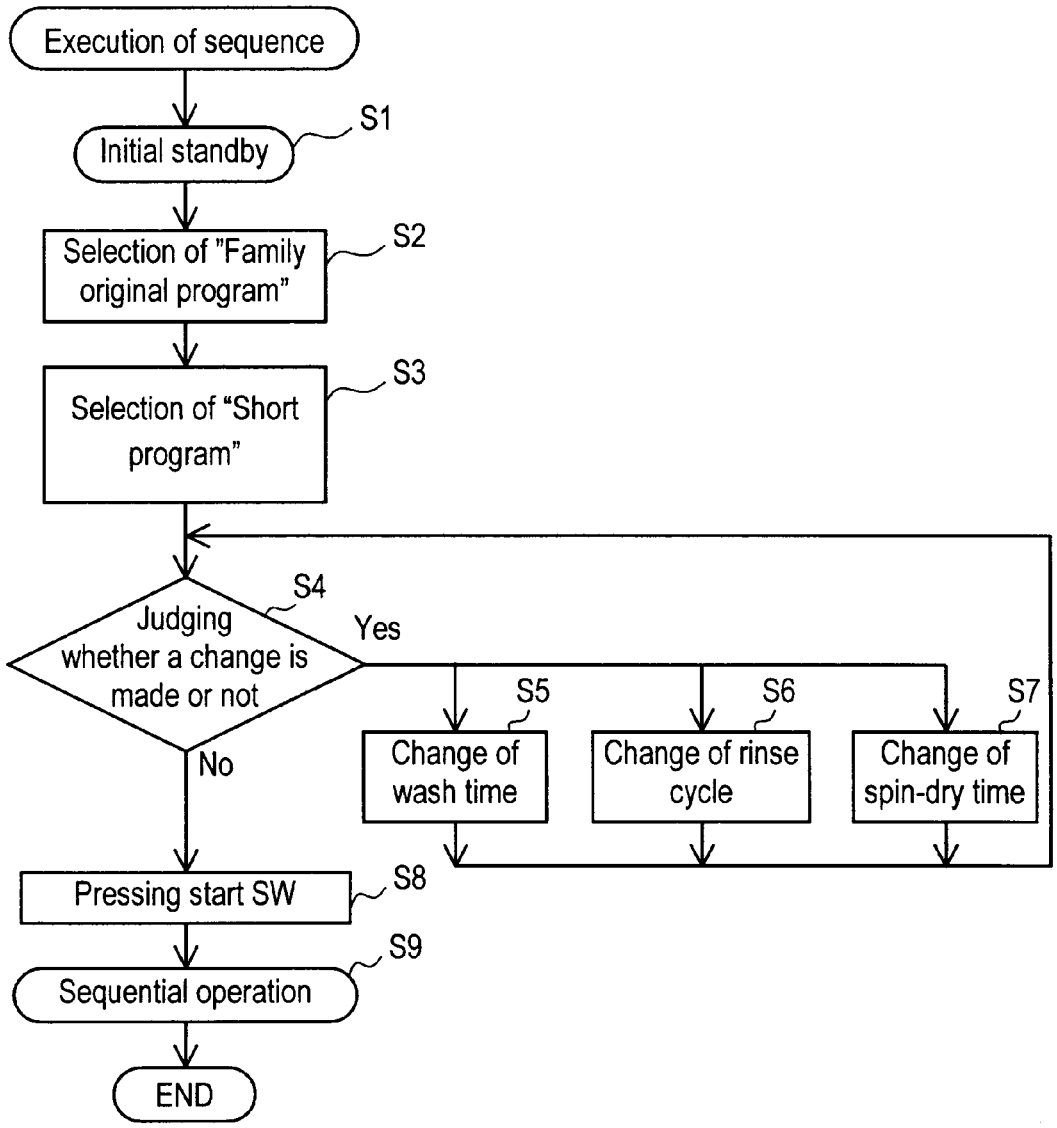
FIG. 6 is a flow chart illustrating an operation of the cloth washer according to the first exemplary embodiment.

Cloth washer 110 constructed as above operates in a manner which is described hereinafter. FIG. 4B is a front view of control panel 8 disposed to cloth washer 110, for the purpose of illustrating a procedure of selecting one of a plurality of the basic operating programs. FIG. 4C is another view of control panel 8 provided for the purpose of illustrating a procedure of correcting specifications of the washing operation, the rinsing operation and the spin-dry operation preprogrammed for any of the basic operating programs selected through control panel 8. FIG. 6 is a flow chart detailing an operation of cloth washer 110 according to the first exemplary embodiment.

First, when the user presses a power button provided on control panel 8, display unit 5 displays a menu for selection of the operating programs of cloth washer 110. In an example shown in FIG. 4A, there are displayed the "regular program", the "family original program", the "in-home cleaning program" and the "heavy-duty program". Among those, the "regular program", the "in-home cleaning program" and the "heavy-duty program" are the basic operating programs, and the "family original program" is the special operating program. This screen shows an initial standby state (Step S1).

When the user selects the "family original program" by touching the touch-sensitive panel disposed to display unit 5 (Step S2), display unit 5 displays at least some of the plurality of basic operating programs, in which specifications for the washing operation, the rinsing operation and the spin-dry operation are preprogrammed individually, as basic programs to aid the user in establishing the "family original program". The "regular program", the "in-home cleaning program", the "heavy-duty program" and the "short program" are displayed in the example shown in FIG. 4B.

Next, when the user touches the touch-sensitive panel disposed to display unit 5 to choose any of the "regular program", the "in-home cleaning program", the "heavy-duty program" and the "short program", selector unit 1 selects one of the basic operating programs displayed in an area where the user touches, as the basic program (Step S3). Subsequently, display unit 5 displays a washing time, a number of rinse cycles and a spin-dry time preprogrammed for the basic operating program selected by selector unit 1. In this embodiment here, description will be provided of an instance in which the "short program" is selected as the basic program.

Special operating program setting unit 2 judges whether or not a change is made on any of the washing time, the number of rinse cycles and the spin-dry time preprogrammed for the basic operating program selected by selector unit 1 (Step S4). If there is a change on the washing time, special operating program setting unit 2 corrects the washing time preprogrammed for the "short program" chosen as the basic program according to the changed washing time (Step S5). The example shown in FIG. 4C indicates that the user has made a correction on the "3 minutes" of washing time preprogrammed for the "short program" to "4 minutes" by touching the touch-sensitive panel disposed to display unit 5.

When the number of rinse cycles is changed, special operating program setting unit 2 corrects the number of rinse cycles preprogrammed for the "short program" chosen as the basic program according to the changed number of rinse cycles (Step S6). The example shown in FIG. 4C indicates that the user has made a correction on the "once with supplying water" in number of rinse cycles preprogrammed for the "short program" to "2 times with supplying water" by touching the touch-sensitive panel disposed to display unit 5.

When the spin-dry time is changed, special operating program setting unit 2 corrects the spin-dry time preprogrammed for the "short program" chosen as the basic program according to the changed spin-dry time (Step S7). The example shown in FIG. 4C indicates that the user has made a correction on the "3 minutes" of spin-dry time preprogrammed for the "short program" to "4 minutes" by touching the touch-sensitive panel disposed to display unit 5.

Next, when the user presses a start switch provided on control panel 8 (Step S8), special operating program setting unit 2 establishes the special operating program as the "family original program" by taking in the corrected specifications of the "short program" as the basic program. Control unit 3 thus controls driving circuit 36 and component drive unit 33 in a manner to carry out the washing operation, the rinsing operation and the spin-dry operation according to the specifications of the special operating program established by special operating program setting unit 2. This status is now in the state of sequential operation (Step S9).

According to the first exemplary embodiment, as described above, the special operating program is established in the manner that selector unit 1 selects one of the plurality of basic operating programs, in which specifications for the washing operation, the rinsing operation and the spin-dry operation are preprogrammed individually, followed by correction of at least one of programmed specifications of the washing operation, the rinsing operation and the spin-dry operation preprogrammed for one of the plurality of basic operating programs selected by selector unit 1. Accordingly, the user can choose a basic program among the plurality of basic operating programs for use as the basis of establishing the special operating program. As a result, it allows the user to set easily the desired operating specifications as the special operating program.

If the user desires to establish a special operating program by making some changes on the "short program", for instance, the user can set the desired washing time, number of rinse cycles and spin-dry time while referring to the washing time, the number of rinse cycles and the spin-dry time preprogrammed for the "short program".

Although what has been described above is an example in which the "short program" is selected as the basic program for establishing the "family original program", this invention is not limited to the above example. The selection can be made for any of the other basic operating programs displayed in display unit 5 as the basic program. When the user desires to establish the special operating program by making some changes on the "in-home cleaning program", for instance, the user can select the "in-home cleaning program" as the basic program. Or, the user can select the "regular program" as the basic program, when the user desires to establish the special operating program by making some changes on the "regular program".

Moreover, although the above example shows only four kinds of the basic operating programs as the basic programs to be displayed in display unit 5 out of the eight available kinds, the invention is not limited to this example. Alternatively, all of the eight kinds of basic operating programs may be displayed for selection as the basic program.

In addition, although the above embodiment is an example in which the correction is made on at least one of the washing time, the number of rinse cycles and the spin-dry time, this structure may be altered so that at least one of strength of the swirling water and the speed of the spin-dry rotation is also made correctable.

Furthermore, FIG. 4C shows an example in which the washing time is selectable among four different durations, i.e. "5 minutes", "4 minutes", "3 minutes" and "2 minutes", however, the invention is not limited only to these time durations. Instead, the invention may be so embodied that the time is set for any duration between "0 minutes" and "29 minutes" in increments of 1 minute, for instance.

Moreover, although the above embodiment is an example in which the special operating program is established by making a correction on at least one of the specifications for the washing operation, the rinsing operation and the spin-dry operation, this invention is not restrictive. The structure may be altered so that the special operating program is established by making a correction on at least one of the specifications for the washing operation, the rinsing operation, the spin-dry operation and a drying operation. Thus, the present invention can be adapted to a cloth washer having a drying function.

(Second Exemplary Embodiment)

Figure 7:
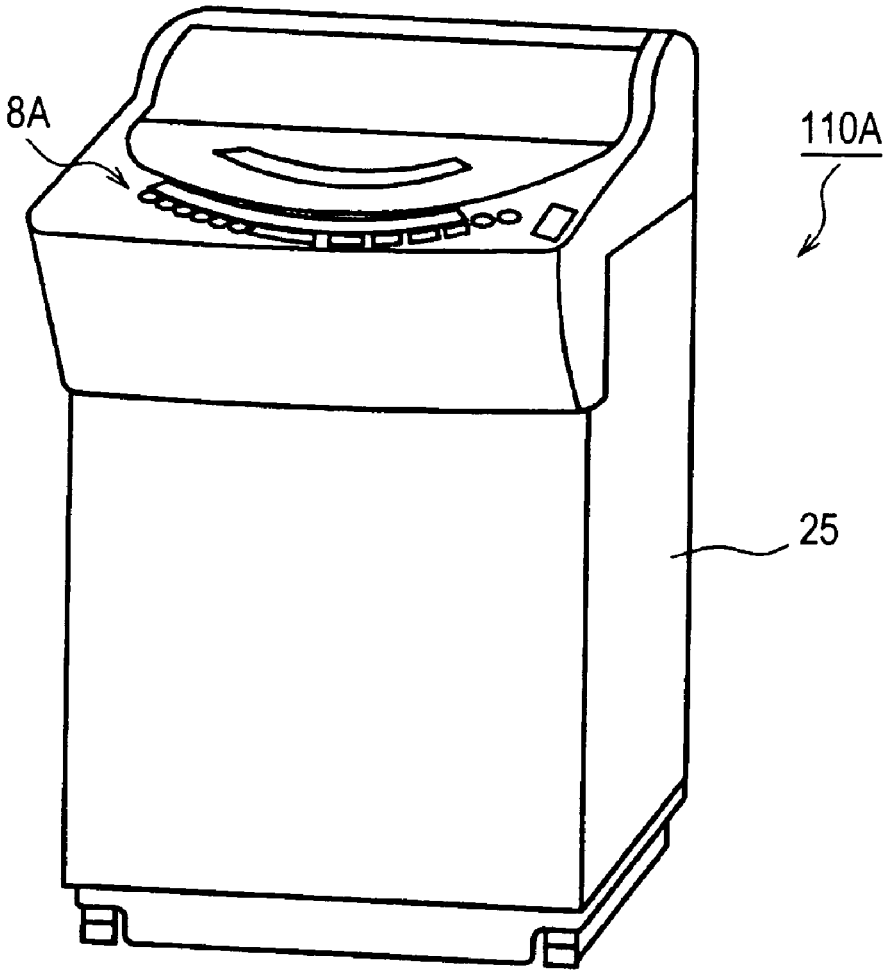
FIG. 7 is a perspective view depicting an exterior of a cloth washer according to a second exemplary embodiment.
Figure 8:
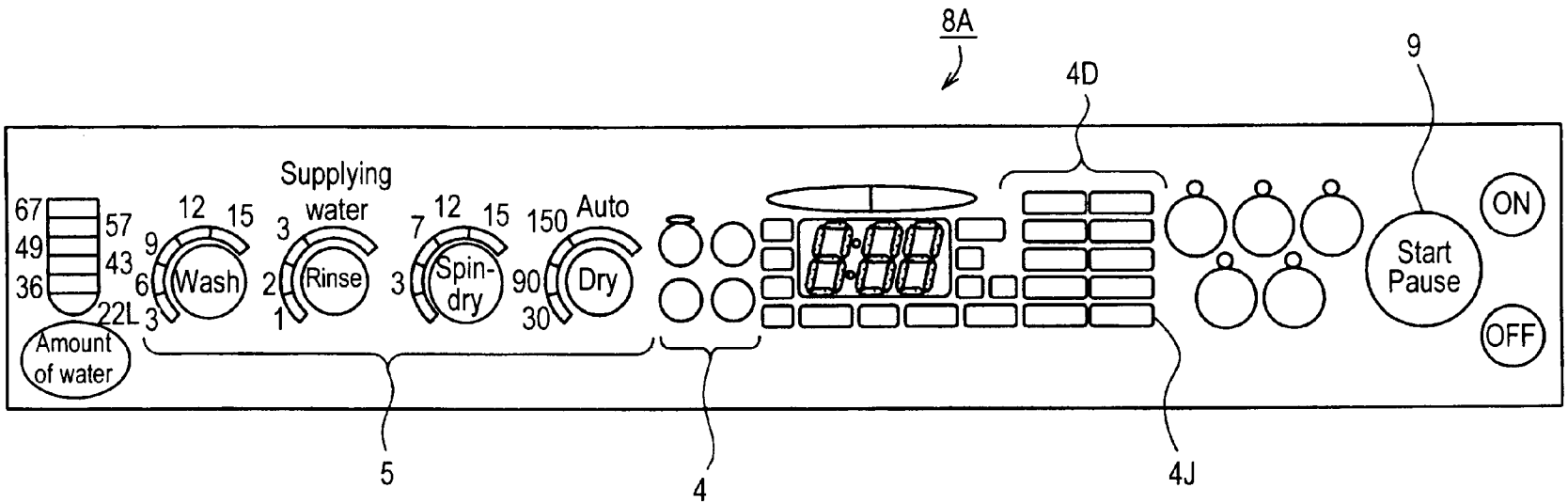
FIG. 8 is a front view showing an exterior of a control panel provided in the cloth washer according to the second exemplary embodiment.

FIG. 7 is a perspective view depicting an exterior of cloth washer 110A according to the second exemplary embodiment, and FIG. 8 is a front view showing control panel 8A provided on cloth washer 110A. Like reference numerals are used to designate like structural components as those of cloth washer 110 described in the above first exemplary embodiment. Accordingly, detailed explanation of these components will be skipped. Cloth washer 110A differs from the above-described cloth washer 110 in respect that it is provided with control panel 8A in place of control panel 8.

Control panel 8A is provided with eight basic operating program selector buttons 4D for selecting each of eight corresponding kinds of basic operating programs. The basic operating programs include "regular program", "soak-wash program", "detergent saving program", "heavy-duty program", "short program", "shirt washing program", in-home cleaning program and "blanket washing program".

Control panel 8A is provided with special operating program selector button 4J for selecting a "special operating program". Control panel 8A also has input unit 4 for entering a washing time for washing operation, a number of rinse cycles for rinsing operation, and a spin-dry time for spin-dry operation, and display unit 5 for displaying the washing time, the number of rinse cycles and the spin-dry time entered from input unit 4.

Figure 9:
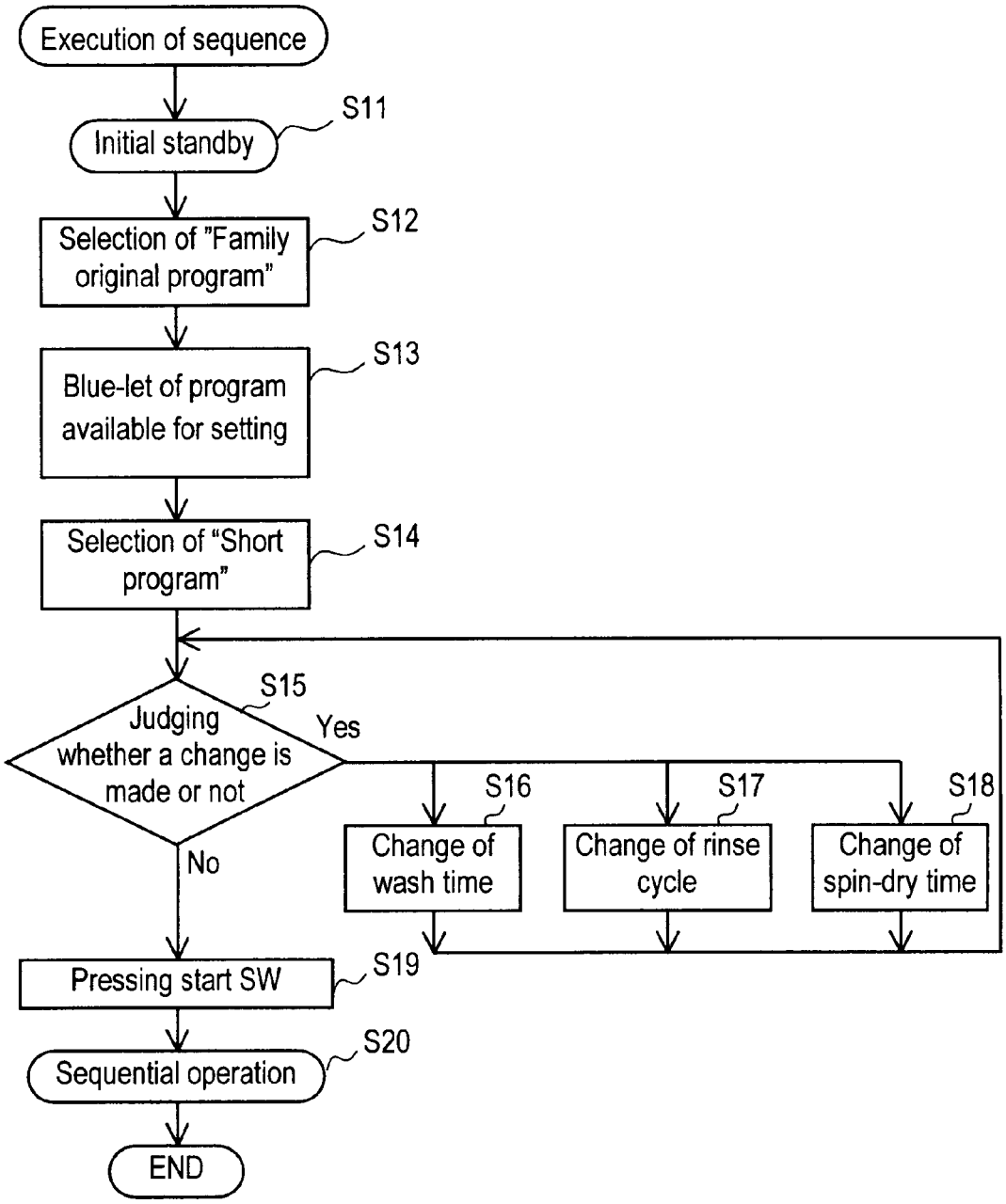
FIG. 9 is a flow chart illustrating an operation of the cloth washer according to the second exemplary embodiment.

Cloth washer 110A constructed as above operates in a manner which is described hereinafter. FIG. 9 is a flow chart illustrating an operation of cloth washer 110A. First, when a user presses a power "on" switch provided on control panel 8A, it turns into an initial standby state (Step S1).

When the user presses special operating program selector button 4J to select the "special operating program" (or, a family original program) (Step S12), a plurality of basic operating program selector buttons 4D out of those eight buttons 4D light up in blue color, indicating that they are the basic operating programs available for selection and for use as a basic program in establishing the special operating program. For example, four basic operating program selector buttons 4D representing the "regular program", the "in-home cleaning program", the "heavy-duty program" and the "short program" light up in blue. In other words, those of basic operating program selector buttons 4D that light up in blue correspond to the programs which can be used for setting as the basic program (Step S13).

Next, when the user presses any of the blue-lit basic operating program selector buttons 4D for the "regular program", the "in-home cleaning program", the "heavy-duty program" and the "short program", selector unit 1 selects one of the basic operating programs represented by basic operating program selector button 4D pressed by the user as a basic program. Display unit 5 then displays a washing time, a number of rinse cycles and a spin-dry time preprogrammed for the basic operating program selected by selector unit 1. Description will be provided in this embodiment on an example in which the "short program" is selected as the basic program (Step S14).

Special operating program setting unit 2 judges whether or not a change is made on any of the washing time, the number of rinse cycles and the spin-dry time preprogrammed for the basic operating program selected by selector unit 1, as the user inputs information for the change through input unit 4 (Step S15). If there is a change on the washing time, special operating program setting unit 2 corrects the washing time preprogrammed for the "short program" chosen as the basic program according to the changed washing time (Step S16). When the number of rinse cycles is changed, special operating program setting unit 2 corrects the number of rinse cycles preprogrammed for the "short program" chosen as the basic program according to the changed number of rinse cycles (Step S17). When the spin-dry time is changed, special operating program setting unit 2 corrects the spin-dry time preprogrammed for the "short program" chosen as the basic program according to the changed spin-dry time (Step S18).

Next, when the user presses start switch 9 provided on control panel 8A (Step S19), special operating program setting unit 2 establishes the special operating program (i.e. "family original program") by taking in the corrected specifications of the "short program" as the basic program. Control unit 3 thus controls driving circuit 36 and component drive unit 33 in a manner to carry out the washing operation, the rinsing operation and the spin-dry operation according to the specifications of the special operating program established by special operating program setting unit 2. The status is now in the state of sequential operation (Step S20).

According to the second exemplary embodiment, as described above, the special operating program is established in the same manner as the first exemplary embodiment, that selector unit 1 selects one of the plurality of basic operating programs, in which specifications for the washing operation, the rinsing operation and the spin-dry operation are preprogrammed individually, followed by correction of at least one of the specifications of the washing operation, the rinsing operation and the spin-dry operation preprogrammed for one of the plurality of basic operating programs selected by selector unit 1. Accordingly, the user can choose a basic program among the plurality of basic operating programs for use as the basis of establishing the special operating program. As a result, it allows the user to set easily the desired operating specifications as the special operating program.

Alternatively, control panel 8A may be provided with a plurality of operating program selection lamps and an operating program selector button so that the operating program selection lamps light up one after another in a sequential order at each time the operating program selector button is pressed. This allows the user to make selection of any of the operating programs and the basic program by simply pressing the operating program selector button.

(Third Exemplary Embodiment)

Figure 10:
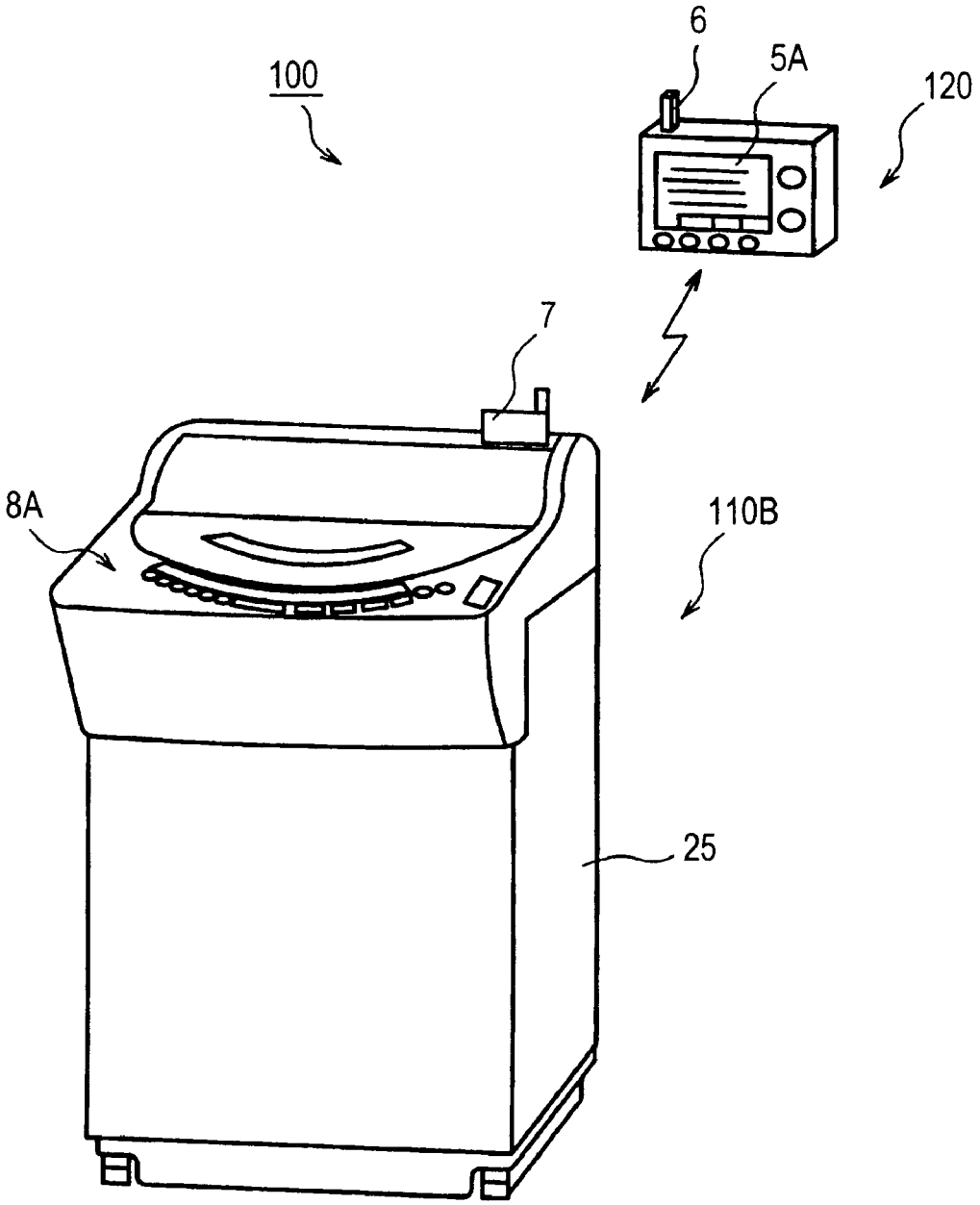
FIG. 10 is a perspective view depicting an exterior of a control system according to a third exemplary embodiment.
Figure 11:
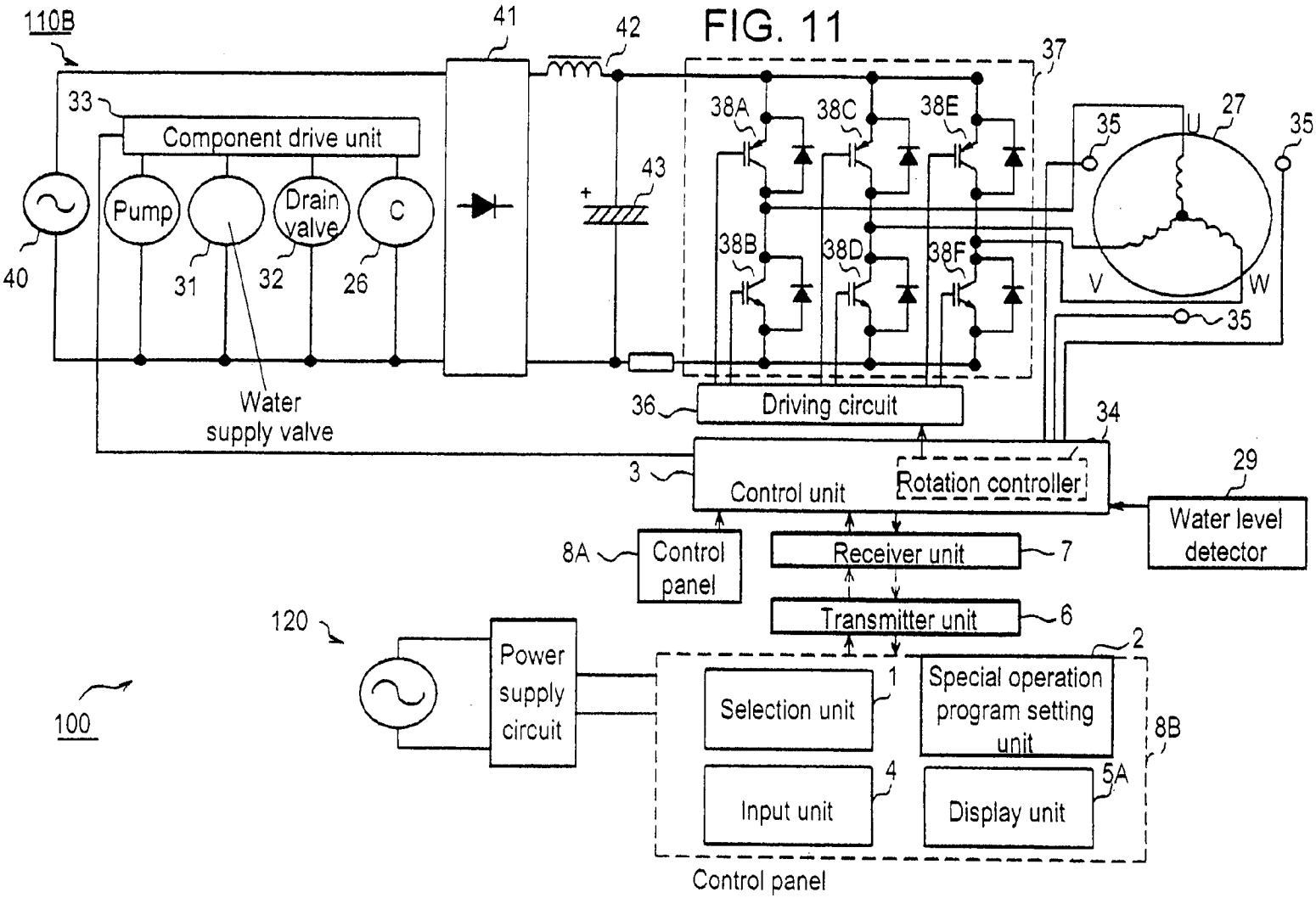
FIG. 11 is a circuit block diagram depicting a structure of the control system according to the third exemplary embodiment.

FIG. 10 is a perspective view depicting an exterior of control system 100 according to the third exemplary embodiment, and FIG. 11 is a circuit block diagram depicting a structure of control system 100. Like reference numerals are used to designate like structural components as those of cloth washer 110 described in the first exemplary embodiment. Accordingly, detailed explanation of these components will be skipped.

Control system 100 is provided with cloth washer 110B and terminal 120 for controlling cloth washer 110B. Terminal 120 and cloth washer 110B are connected via a network using wireless communications. Terminal 120 is provided with control panel 8B.

Figure 12A:
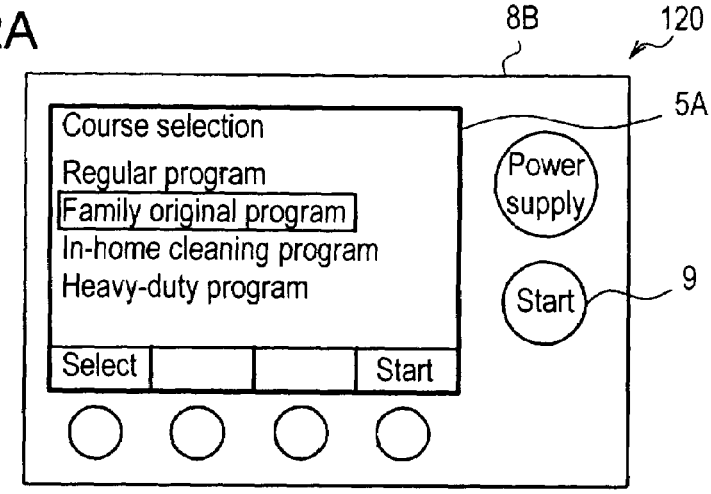
FIG. 12A is a front view illustrating a control panel provided in a terminal according to the third exemplary embodiment.

FIG. 12A is a front view illustrating control panel 8B provided on terminal 120. Control panel 8B has selector unit 1 as is referred to in FIG. 10, FIG. 11 and FIG. 12A. Selector unit 1 selects one of a plurality of basic operating programs in which specifications for washing operation, rinsing operation and spin-dry operation to be performed by cloth washer 110B are preprogrammed.

Control panel 8B is provided with special operating program setting unit 2. Special operating program setting unit 2 establishes a special operating program by correcting at least one of the specifications of the washing operation, the rinsing operation and the spin-dry operation that are preprogrammed for the one of the plurality of basic operating programs selected by selector unit 1.

Terminal 120 is provided with transmitter unit 6. Transmitter unit 6 transmits information containing the specifications of the special operating program established by special operating program setting unit 2 via the wireless network.

Terminal 120 is also provided with a power supply for supplying electric power to control panel 8B and transmitter unit 6. The power supply may be comprised of a battery.

Control panel 8B has input unit 4. Input unit 4 accepts entry of selection information for selecting one of the plurality of basic operating programs and correction information for correcting at least one of the specifications of the washing operation, the rinsing operation and the spin-dry operation preprogrammed for the selected one of the plurality of basic operating programs.

Control panel 8B is also provided with display unit 5A. Display unit 5A displays the specifications of the washing operation, the rinsing operation and the spin-dry operation preprogrammed for the one of the plurality of basic operating programs selected by selector unit 1, and the correction information entered through input unit 4. Input unit 4 comprises a touch-sensitive panel, and it is formed in a manner to cover display unit 5A.

Cloth washer 110B has receiver unit 7. Receiver unit 7 receives the information containing the specifications of the special operating program transmitted by transmitter unit 6 provided in terminal 120.

Cloth washer 110B also has control unit 3. Control unit 3 is provided for carrying out the washing operation, the rinsing operation and the spin-dry operation according to the information representing the specifications of the special operating program received by receiver unit 7.

Figure 12B:
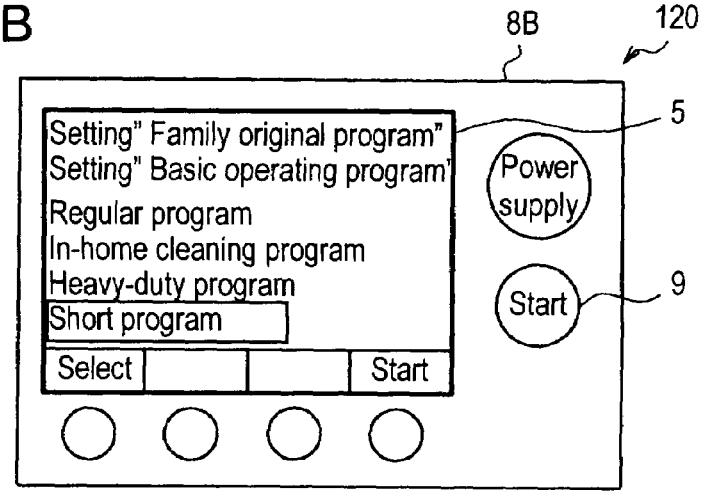
FIG. 12B is another view of the control panel provided in the terminal of the third exemplary embodiment, illustrating a procedure of selecting one of a plurality of basic operating programs.
Figure 12C:
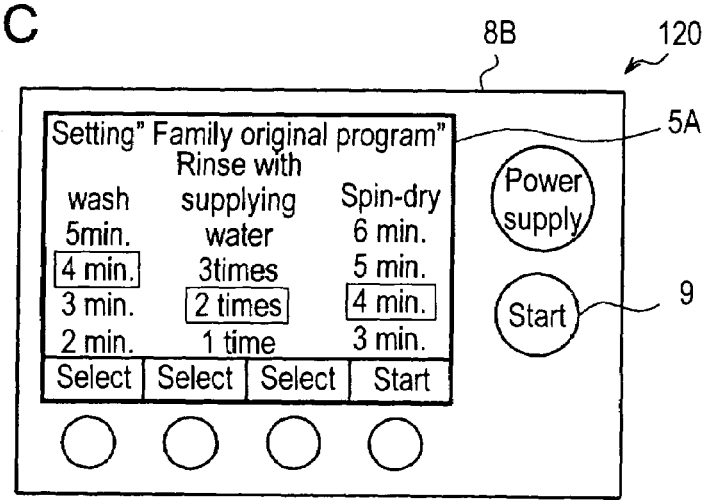
FIG. 12C is still another view of the control panel provided in the terminal of the third exemplary embodiment, illustrating a procedure of correcting specifications of washing operation, rinsing operation and spin-dry operation preprogrammed for the selected one of the basic operating programs.
Figure 13:
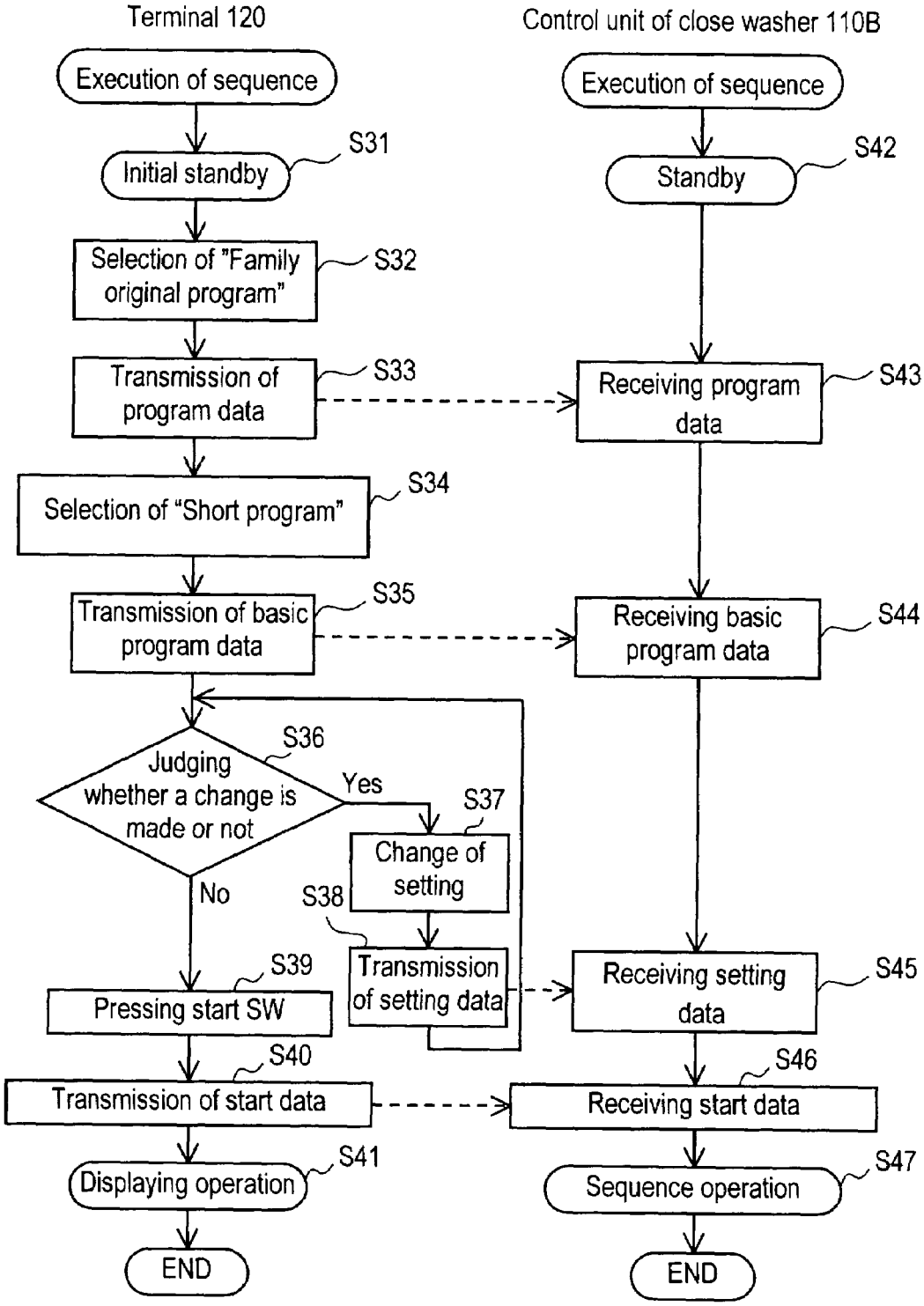
FIG. 13 is a flow chart illustrating an operation of the control system according to the third exemplary embodiment.

Control system 100 constructed as above operates in a manner which is described hereinafter. FIG. 12B is a front view of control panel 8B provided in terminal 120, illustrating a procedure of selecting one of the plurality of basic operating programs, and FIG. 12C is another front view of control panel 8B, illustrating a procedure of correcting the specifications of the washing operation, the rinsing operation and the spin-dry operation preprogrammed for the selected one of the basic operating programs. FIG. 13 is a flow chart showing an operation of control system 100.

First, when a user presses a power button provided on control panel 8B of terminal 120, display unit 5A provided on control panel 8B displays a menu for selection of the operating programs. In an example shown in FIG. 12A, there are displayed a "regular program", a "family original program", an "in-home cleaning program" and a "heavy-duty program". Among those, the "regular program", the "in-home cleaning program" and the "heavy-duty program" are basic operating programs, and the "family original program" is a special operating program. This screen shows an initial standby state (Step S31). Cloth washer 110B also turns into a standby state when the user presses another power button provided on cloth washer 110B (Step S42).

When the user selects the "family original program" by touching the touch-sensitive panel disposed to display unit 5A on control panel 8B (Step S32), display unit 5A displays at least some of the plurality of basic operating programs, in which specifications for the washing operation, the rinsing operation and the spin-dry operation are preprogrammed individually, as the basic programs to aid the user in establishing the "family original program". The "regular program", the "in-home cleaning program", the "heavy-duty program" and the "short program" are displayed in the example shown in FIG. 12B.

Next, transmitter unit 6 provided in terminal 120 transmits a information representing the selected "family original program" to receiver unit 7 provided in cloth washer 110B through the wireless network. In other words, terminal 120 transmits a program data (Step S33). Receiver unit 7 then receives the information representing the "family original program" transmitted from transmitter unit 6. That is, the control unit in cloth washer 110B receives the program data (Step S43).

Transmitter unit 6 provided in terminal 120 and receiver unit 7 provided in cloth washer 110B communicate the information according to the ECHONET Standard. The ECHONET Standard is a standard used to link household electric appliances through the network, and it helps configure universal open system that facilitates connections of the household electric appliances to the network and controls them easily especially in existing houses.

Next, when the user touches the touch-sensitive panel disposed to display unit 5A on terminal 120 to choose any of the "regular program", the "in-home cleaning program", the "heavy-duty program" and the "short program", selector unit 1 provided in control panel 8B selects one of the basic operating programs displayed in an area where the user touches, as the basic program (Step S34). Subsequently, display unit 5A displays a washing time, a number of rinse cycles and a spin-dry time preprogrammed for the basic operating program selected by selector unit 1. In this embodiment here, description will be provided of an instance in which the "short program" is selected as the basic program.

Transmitter unit 6 provided in terminal 120 transmits a information representing the "short program" selected by selector unit 1 as the basic program to receiver unit 7 provided in cloth washer 110B through the wireless network. In other words, transmitter unit 6 transmits a basic program data (Step S35). Receiver unit 7 then receives the information representing the "short program" transmitted from transmitter unit 6. That is, receiver unit 7 receives the basic program data (Step S44).

Special operating program setting unit 2 provided in control panel 8B judges whether or not a change is made on any of the washing time, the number of rinse cycles and the spin-dry time preprogrammed for the basic operating program selected by selector unit 1 (Step S36). If there is a change on the washing time, special operating program setting unit 2 corrects the washing time preprogrammed for the "short program" chosen as the basic program according to the changed washing time. The example shown in FIG. 12C indicates that the user has made a change on the "3 minutes" of washing time preprogrammed for the "short program" to "4 minutes" by touching the touch-sensitive panel disposed to display unit 5A.

When the number of rinse cycles is changed, special operating program setting unit 2 corrects the number of rinse cycles preprogrammed for the "short program" chosen as the basic program according to the changed number of rinse cycles. The example shown in FIG. 12C indicates that the user has made a change on the "once with supplying water" in number of rinse cycles preprogrammed for the "short program" to "2 times with supplying water" by touching the touch-sensitive panel disposed to display unit 5A.

When the spin-dry time is changed, special operating program setting unit 2 corrects the spin-dry time preprogrammed for the "short program" chosen as the basic program according to the changed spin-dry time. The example shown in FIG. 12C indicates that the user has made a change on the "3 minutes" of spin-dry time preprogrammed for the "short program" to "4 minutes" by touching the touch-sensitive panel disposed to display unit 5A (Step S37).

Next, special operating program setting unit 2 sets the corrected specifications of the "short program" or the basic program, as the special operating program (i.e. the "family original program"). Thereafter, transmitter unit 6 provided in terminal 120 transmits a information representing the specifications of the special operating program (the "family original program") established by special operating program setting unit 2 to receiver unit 7 provided in cloth washer 110B through the wireless network. In other words, transmitter unit 6 transmits a setting data (Step S38). Receiver unit 7 then receives the information representing the specifications of the special operating program (the "family original program") transmitted from transmitter unit 6. That is, receiver unit 7 receives the setting data (Step S45).

Next, when the user presses start switch 9 provided in control panel 8A (Step S39), transmitter unit 6 provided in terminal 120 transmits a information indicating that start switch 9 is pressed to receiver unit 7 provided in cloth washer 110B through the wireless network. In other words, transmitter unit 6 transmits a start data (Step S40). Receiver unit 7 then receives the information indicating that start switch 9 is pressed, which is transmitted from transmitter unit 6. That is, receiver unit 7 receives the start data (Step S46).

Control unit 3 provided in cloth washer 110B thus controls driving circuit 36 and component drive unit 33 in a manner to carry out the washing operation, the rinsing operation and the spin-dry operation according to the information representing the specifications of the special operating program received by receiver unit 7 in the step S45. This status is now in the state of sequential operation (Step S47). Display unit 5A provided on terminal 120 displays information showing that cloth washer 110B is in operation (Step S41).

According to the third exemplary embodiment, as described above, selector unit 1 provided in terminal 120 selects one of the plurality of basic operating programs, in which specifications for the washing operation, the rinsing operation and the spin-dry operation are preprogrammed individually. The special operating program is thus established by correcting at least one of the specifications of the washing operation, the rinsing operation and the spin-dry operation preprogrammed for the one selected by selector unit 1 among the plurality of basic operating programs. Accordingly, the user can choose a basic operating program among the plurality of basic operating programs for use as the basis of establishing the special operating program. As a result, it allows the user to set easily the desired operating specifications as the special operating program. In this embodiment, cloth washer 110B does not have to be provided with control panel 8A.

Figure 14:
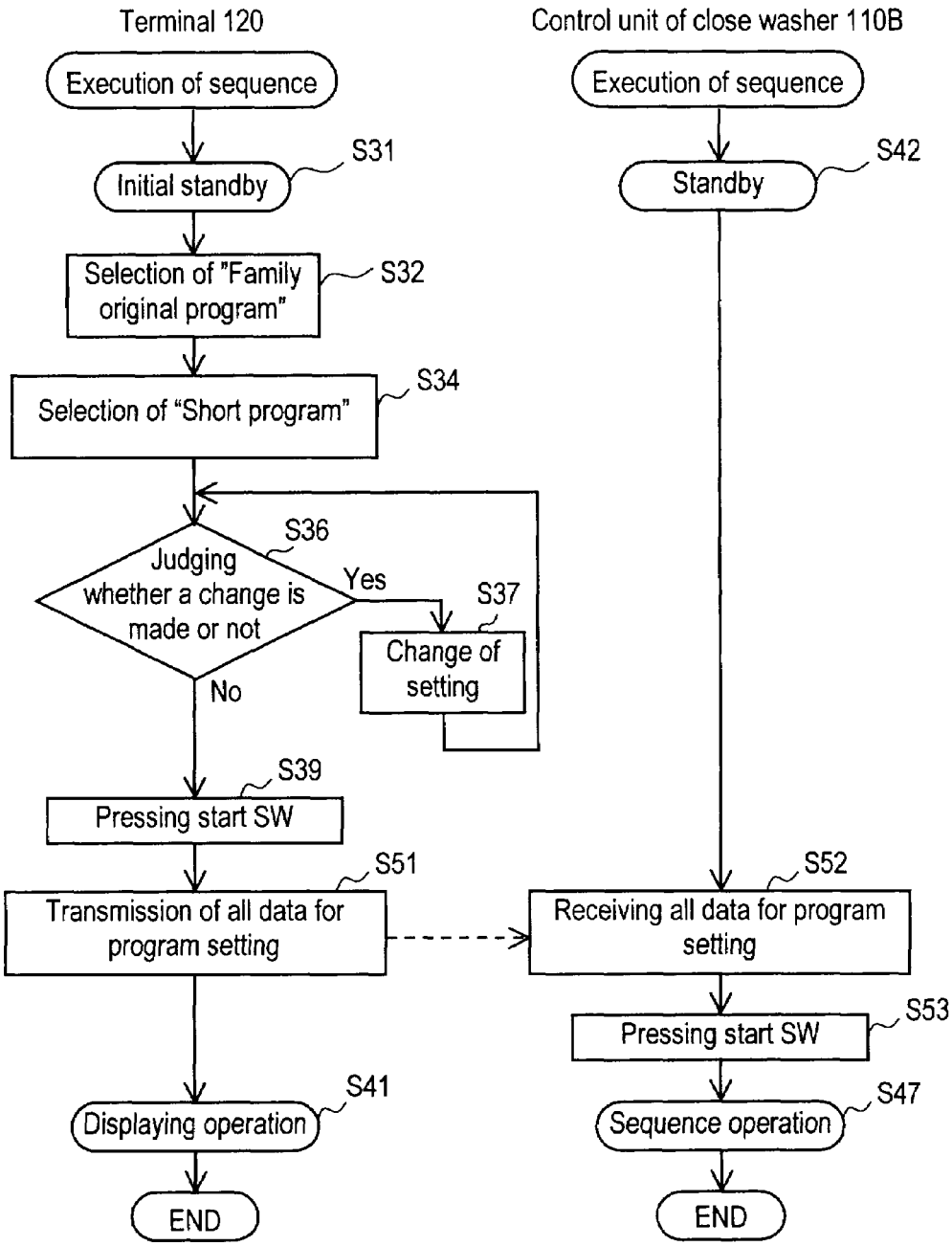
FIG. 14 is a flow chart illustrating another operation of the control system according to the third exemplary embodiment.

FIG. 14 is a flow chart showing another operation of control system 100 according to the third exemplary embodiment. Like reference marks are used to designate like procedural steps as those of the flow chart shown in FIG. 13. Accordingly, detailed explanation of these steps will be skipped. The flow chart in FIG. 14 differs from that shown in FIG. 13 in respect that transmitter unit 6 transmits to receiver unit 7 all kinds of data at once immediately after the step S39 when the user presses start switch 9 provided in control panel 8B of terminal 120. That is, transmitter unit 6 transmits all the data for program setting (Step S51).

First, when the user presses a start button 9 provided on control panel 8B of terminal 120, display unit 5A provided on control panel 8B displays a menu for selection of the operating programs. In an example shown in FIG. 12A, there are displayed the "regular program", the "family original program", the "in-home cleaning program" and the "heavy-duty program". Among those, the "regular program", the "in-home cleaning program" and the "heavy-duty program" are the basic operating programs, and the "family original program" is the special operating program (Step S31). Cloth washer 110B turns into a standby state when the user presses the power button provided on cloth washer 110B (Step S42).

When the user selects the "family original program" by touching the touch-sensitive panel disposed over display unit 5A on control panel 8B (Step S32), display unit 5A displays at least some of the plurality of basic operating programs, in which specifications for the washing operation, the rinsing operation and the spin-dry operation are preprogrammed individually, as basic programs to aid the user in establishing the "family original program". In the example shown in FIG. 12B, the "regular program", the "in-home cleaning program", the "heavy-duty program" and the "short program" are displayed as the basic programs.

Next, when the user touches the touch-sensitive panel disposed to display unit 5A on terminal 120 to choose any of the "regular program", the "in-home cleaning program", the "heavy-duty program" and the "short program", selector unit 1 provided in control panel 8B selects one of the basic operating programs displayed in an area where the user touches, as the basic program (Step S34). Subsequently, display unit 5A displays a washing time, a number of rinse cycles and a spin-dry time preprogrammed for the basic operating program selected by selector unit 1 as the basic program. In this embodiment here, description will be provided of an instance in which the "short program" is selected as the basic program.

Special operating program setting unit 2 provided in control panel 8B judges whether or not a change is made on any of the washing time, the number of rinse cycles and the spin-dry time preprogrammed for the basic operating program selected by selector unit 1 as the basic program (Step S36). If there is a change on the washing time, special operating program setting unit 2 corrects the washing time preprogrammed for the "short program" chosen as the basic program according to the changed washing time. The example shown in FIG. 12C indicates that the user has made a change on the "3 minutes" of washing time preprogrammed for the "short program" to "4 minutes" by touching the touch-sensitive panel disposed to display unit 5A.

When the number of rinse cycles is changed, special operating program setting unit 2 corrects the number of rinse cycles preprogrammed for the "short program" chosen as the basic program according to the changed number of rinse cycles. The example shown in FIG. 12C indicates that the user has made a change on the "once with supplying water" in number of rinse cycles preprogrammed for the "short program" to "2 times with supplying water" by touching the touch-sensitive panel disposed to display unit 5A.

When the spin-dry time is changed, special operating program setting unit 2 corrects the spin-dry time preprogrammed for the "short program" chosen as the basic program according to the changed spin-dry time. The example shown in FIG. 12C indicates that the user has made a change on the "3 minutes" of spin-dry time preprogrammed for the "short program" to "4 minutes" by touching the touch-sensitive panel disposed to display unit 5A (Step S37).

Next, when start switch 9 provided on control panel 8B is pressed (Step S39), transmitter unit 6 provided in terminal 120 transmits a information representing the selected "family original program", another information representing the "short program" selected by selector unit 1 as the basic program, and also another information representing the specifications of the special operating program (the "family original program") established by special operating program setting unit 2, to receiver unit 7 provided in cloth washer 110B via the wireless network. In other words, transmitter unit 6 transmits all the data for program setting (Step S51). Receiver unit 7 then receives the information transmitted from transmitter unit 6. That is, receiver unit 7 receives all the data for program setting (Step S52).

When the user presses the start switch provided on cloth washer 110B (Step S53), control unit 3 provided in cloth washer 110B controls driving circuit 36 and component drive unit 33 in a manner to carry out the washing operation, the rinsing operation and the spin-dry operation according to the information received by receiver unit 7 in the step S52. This status is now in the state of sequential operation (Step S47). Display unit 5A provided on terminal 120 displays information showing that cloth washer 110B is in operation (Step S41).

The invention may be embodied into such a structure that the cloth washer begins operating when the start switch on the terminal side is pressed, or when another start switch on the cloth washer side is pressed.

Although the embodiment discussed above is an example in which terminal 120 and cloth washer 110B are connected via the wireless network, they may be connected via infrared rays or the Bluetooth communications.

(Fourth Exemplary Embodiment)

Figure 15:
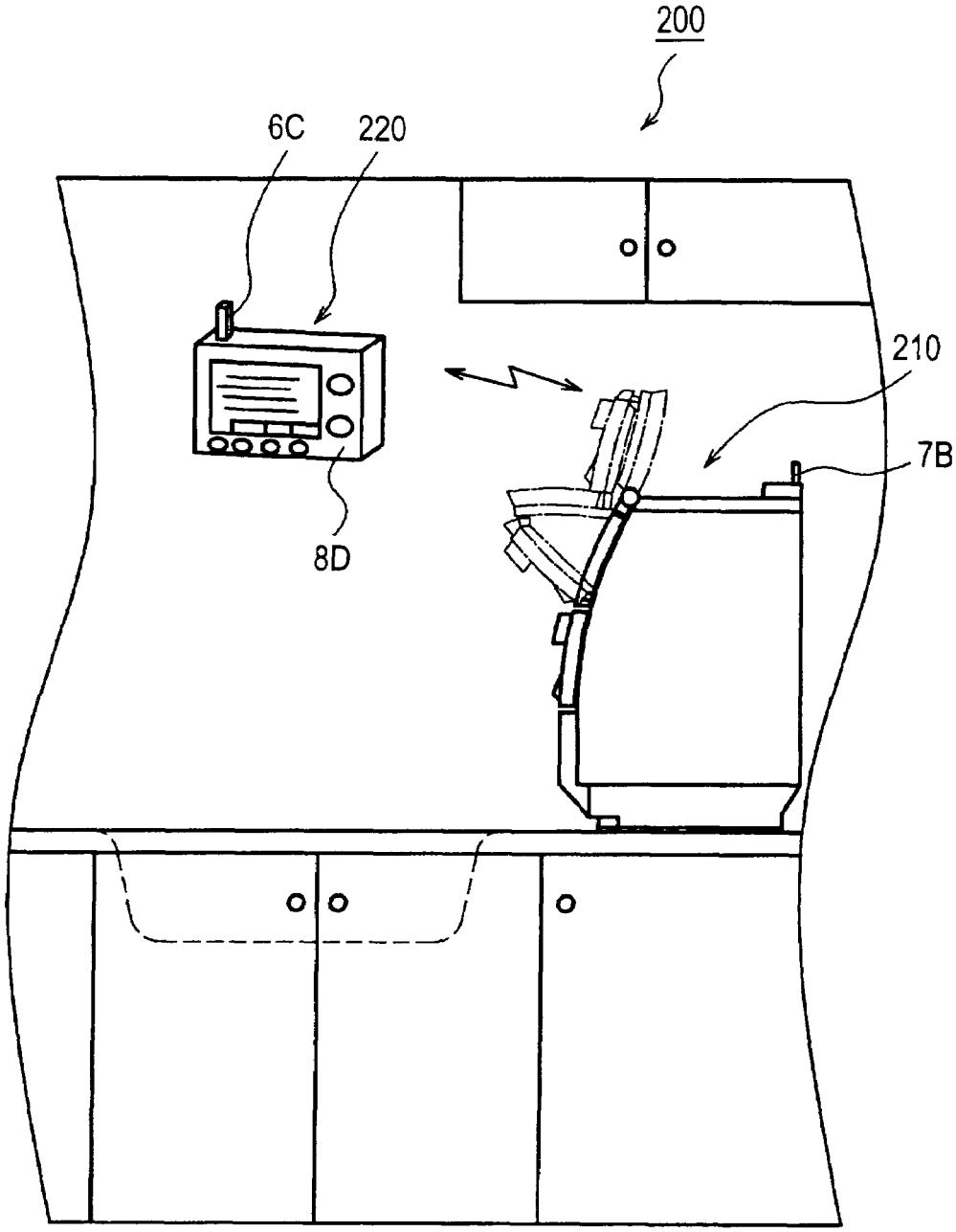
FIG. 15 is a front view depicting an exterior of a control system according to a fourth exemplary embodiment.
Figure 16:
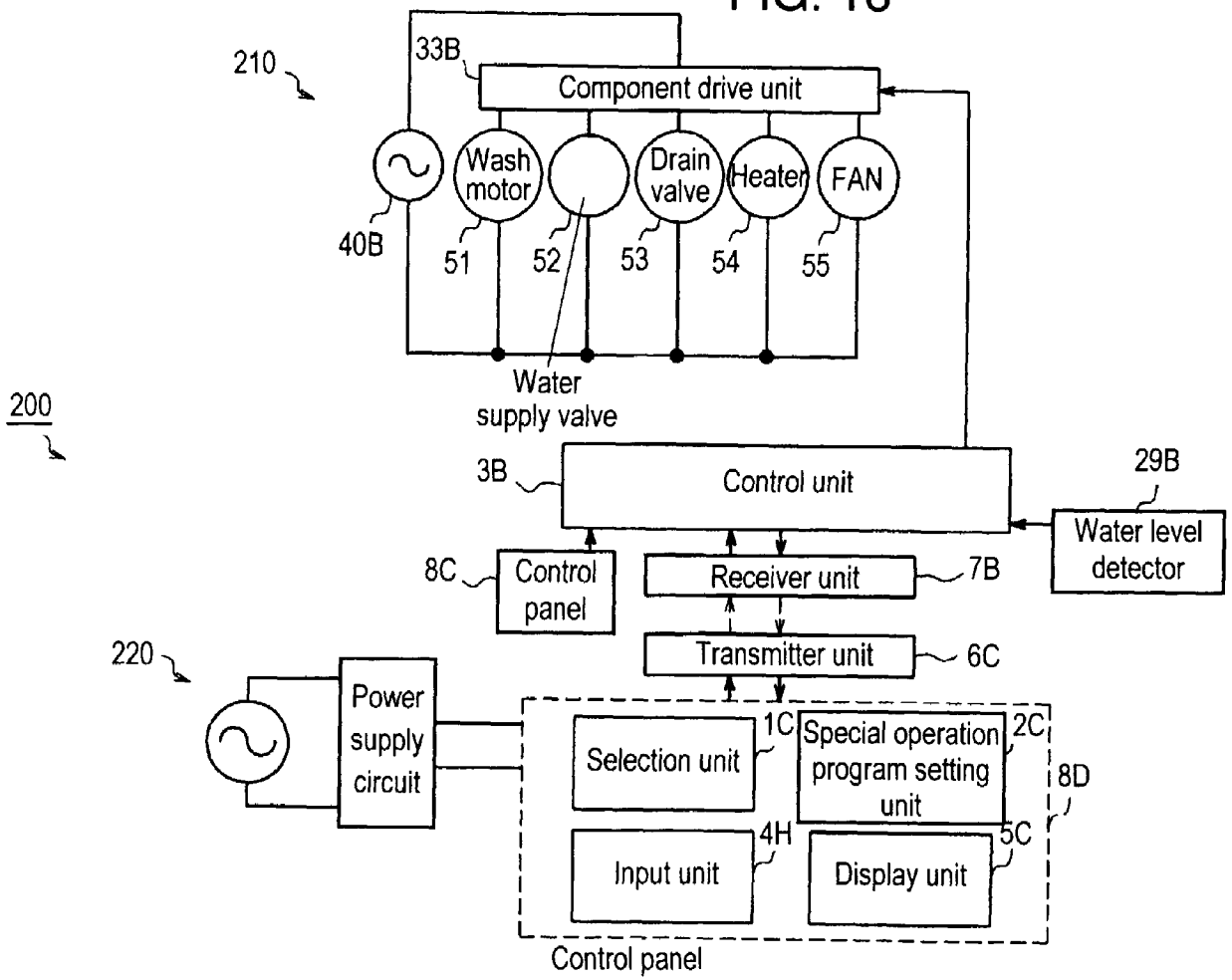
FIG. 16 is a circuit block diagram depicting a structure of the control system according to the fourth exemplary embodiment.

FIG. 15 is a front view depicting an exterior of control system 200 according to the fourth exemplary embodiment, and FIG. 16 is a circuit block diagram showing a structure of control system 200. Control system 200 comprises dish washer-dryer 210 and terminal 220 for controlling dish washer-dryer 210. Terminal 220 and dish washer-dryer 210 are connected with each other via a network using wireless communications.

Figure 17A:
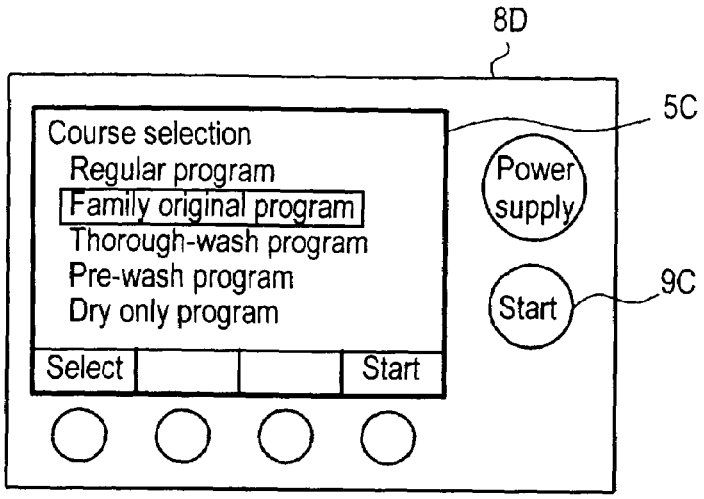
FIG. 17A is a front view illustrating a control panel provided in a terminal according to the fourth exemplary embodiment.

Terminal 220 is provided with control panel 8D. FIG. 17A is a front view illustrating control panel 8D. Control panel 8D has selector unit 1C as is referred to in FIG. 15, FIG. 16 and FIG. 17A. Selector unit selects one of a plurality of basic operating programs in which specifications for washing operation, rinsing operation and drying operation to be performed by dish washer-dryer 210 are preprogrammed.

Control panel 8D is provided with special operating program setting unit 2C. Special operating program setting unit 2C establishes a special operating program by correcting at least one of the specifications of the washing operation, the rinsing operation and the drying operation that are preprogrammed for the one of the plurality of basic operating programs selected by selector unit 1C.

Terminal 220 is provided with transmitter unit 6C. Transmitter unit 6C transmits a information containing the specifications of the special operating program established by special operating program setting unit 2C via the wireless network.

Control panel 8D has input unit 4H. Input unit 4H accepts entry of selection information for selecting one of the plurality of basic operating programs and correction information for correcting at least one of the specifications of the washing operation, the rinsing operation and the drying operation preprogrammed for the selected one of the plurality of basic operating programs.

Control panel 8D is also provided with display unit 5C. Display unit 5C displays the specifications of the washing operation, the rinsing operation and the drying operation preprogrammed for the one of the plurality of basic operating programs selected by selector unit 1C, and the correction information entered through input unit 4H. Input unit 4H comprises a touch-sensitive panel, and it is formed in a manner to cover display unit 5C.

Dish washer-dryer 210 has component drive unit 33B. Component drive unit 33B is provided for driving individually, wash motor 51, water supply valve 52, drain motor 53, heater 54, and fan 55. Dish washer-dryer 210 is also provided with power supply 40B. Power supply 40B delivers a voltage to component drive unit 33B, wash motor 51, water supply valve 52, drain motor 53, heater 54 and fan 55.

Figure 18:
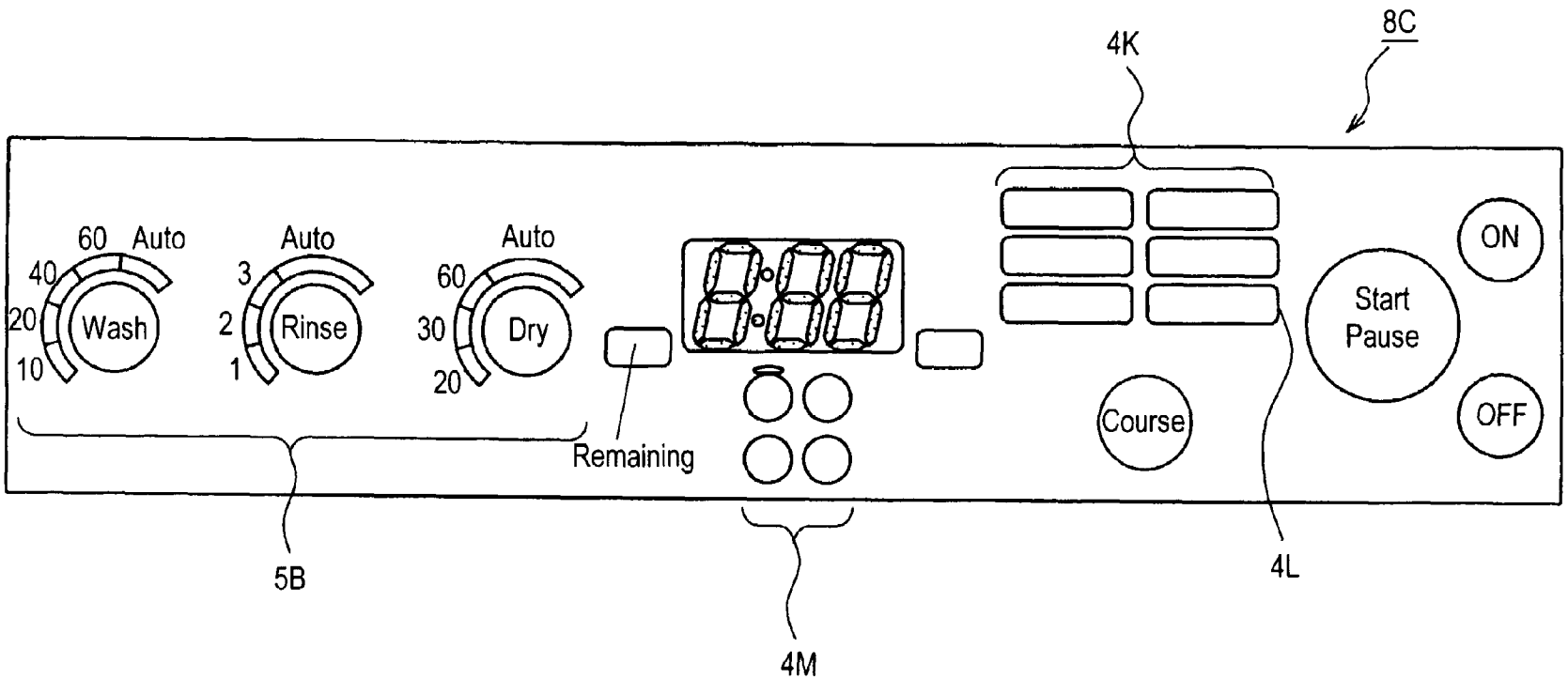
FIG. 18 is a front view illustrating a control panel provided in a dish washer-dryer according to the fourth exemplary embodiment.

Dish washer-dryer 210 has control panel 8C. FIG. 18 is a front view illustrating control panel 8C. Control panel 8C is provided with five basic operating program selector buttons 4K for selecting five kinds of corresponding basic operating programs. The basic operating programs include "regular program", "thorough-wash program", "quick-wash program", "pre-wash program" and "dry only program".

Control panel 8C is also provided with special operating program selector button 4L for selecting a "special operating program". Control panel 8C also has input unit 4M for accepting entry of a washing time for the washing operation, a number of rinse cycles for the rinsing operation and a drying time for the drying operation, and display unit 5B for displaying the washing time, the number of rinse cycles and the drying time entered from input unit 4M.

Dish washer-dryer 210 is provided with receiver unit 7B. Receiver unit 7B receives the information containing the specifications of the special operating program transmitted by transmitter unit 6C provided in terminal 220.

Dish washer-dryer 210 is also provided with control unit 3B for carrying out the washing operation, the rinsing operation and the drying operation according to the information representing the specifications of the special operating program received by receiver unit 7B and a water level detected by water level detector 29B.

Figure 17B:
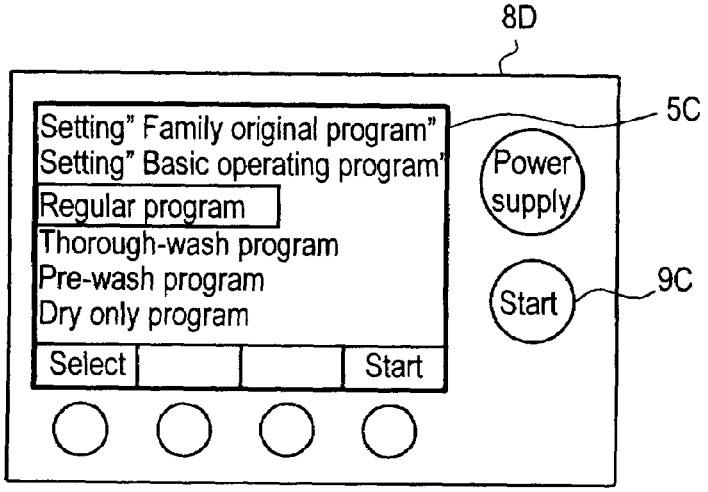
FIG. 17B is another view of the control panel provided in the terminal of the fourth exemplary embodiment, illustrating a procedure of selecting one of a plurality of basic operating programs.
Figure 17C:
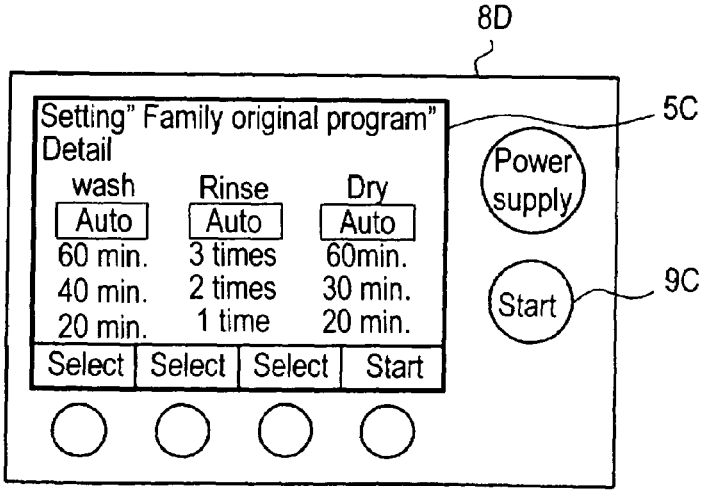
FIG. 17C still another view of the control panel provided in the terminal of the fourth exemplary embodiment, illustrating a procedure of correcting specifications of washing operation, rinsing operation and drying operation preprogrammed for the selected one of the basic operating programs.
Figure 19:
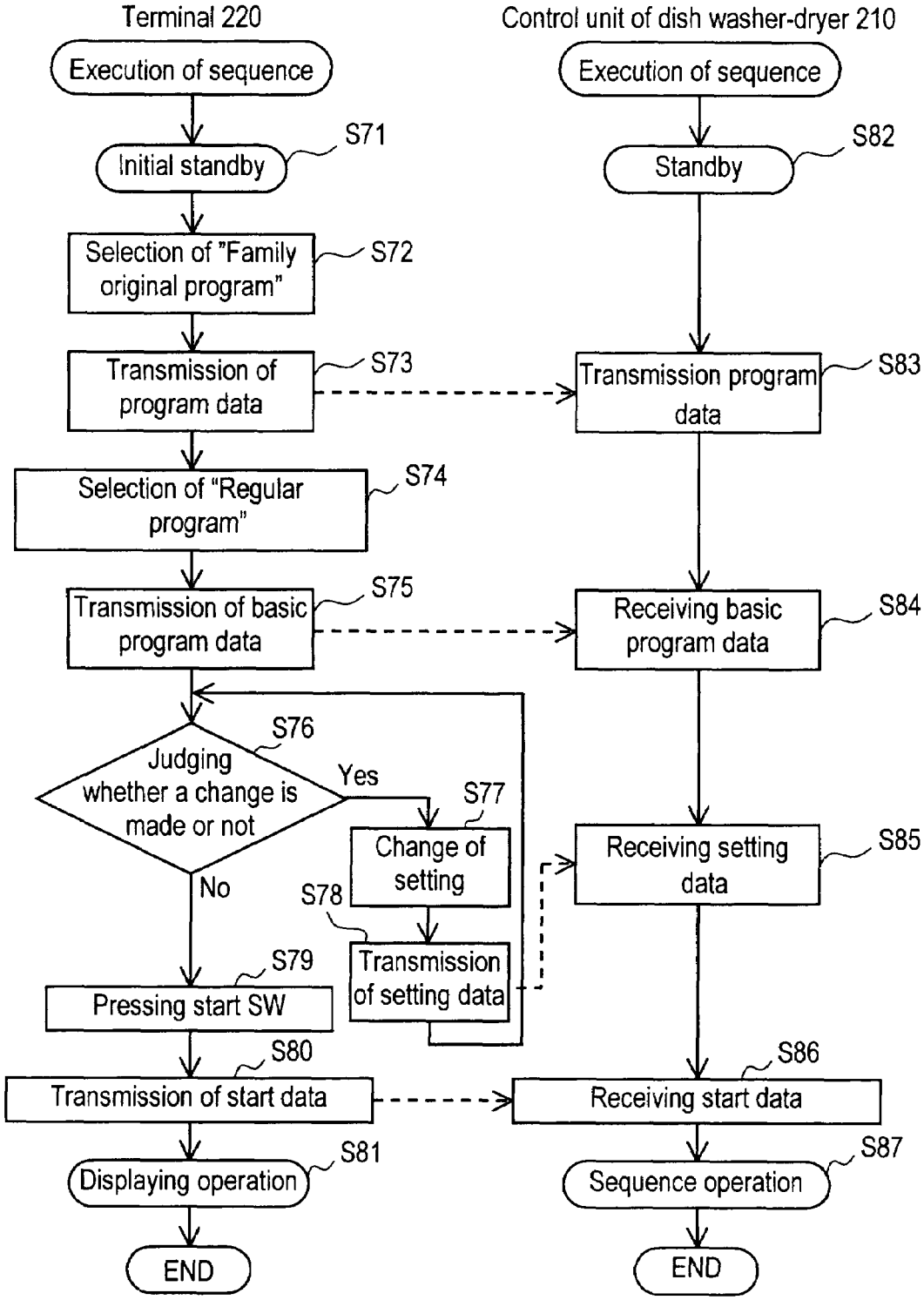
FIG. 19 is a flow chart illustrating an operation of the control system according to the fourth exemplary embodiment.

Control system 200 constructed as above operates in a manner which will be described hereinafter. FIG. 17B is a front view of control panel 8D provided in terminal 220, illustrating a procedure of selecting one of the plurality of basic operating programs, and FIG. 17C is another front view of control panel 8D, illustrating a procedure of correcting the specifications of the washing operation, the rinsing operation and the drying operation preprogrammed for the selected one of the basic operating programs. FIG. 19 is a flow chart showing an operation of control system 200.

First, when a user presses a start button 9C provided on control panel 8D of terminal 220, display unit 5C provided on control panel 8D displays a menu for selection of the operating programs. In an example shown in FIG. 17A, there are displayed "regular program", "family original program", "thorough-wash program", "pre-wash program" and "dry only program". Among those, the "regular program", the "thorough-wash program", the "pre-wash program" and the "dry only program" are the basic operating programs, and the "family original program" is a special operating program. This status is a standby state (Step S71). Dish washer-dryer 210 also turns into a standby state when the user presses another power button provided on dish washer-dryer 210 (Step S82).

When the user selects the "family original program" by touching the touch-sensitive panel disposed to display unit 5C (Step S72), display unit 5C displays at least some of the plurality of basic operating programs, in which specifications for the washing operation, the rinsing operation and the drying operation are preprogrammed individually, as the basic programs to aid the user in establishing the "family original program". The "regular program", the "thorough-wash program", the "pre-wash program" and the "dry only program" are displayed in the example shown in FIG. 17B.

Next, transmitter unit 6C provided in terminal 220 transmits a information representing the selected "family original program" to receiver unit 7B provided in dish washer-dryer 210 over the wireless network. In other words, transmitter unit 6C transmits a program data (Step S73). Receiver unit 7B then receives the information representing the "family original program" transmitted from transmitter unit 6C. That is, receiver unit 7B receives the program data (Step S83). Transmitter unit 6C provided in terminal 220 and receiver unit 7B provided in dish washer-dryer 210 communicate the information using the previously described ECHONET Standard.

Next, when the user touches the touch-sensitive panel disposed to display unit 5C of terminal 220 to choose any of the "regular program", the "thorough-wash program", the "pre-wash program" and the "dry only program", selector unit 1C provided in control panel 8D selects one of the basic operating programs displayed in an area where the user touches, as the basic program (Step S74). Subsequently, display unit 5C displays a washing time, a number of rinse cycles and a drying time preprogrammed for the basic operating program selected by selector unit 1C. In this embodiment here, description will be provided of an instance in which the "regular program" is selected as the basic program.

Transmitter unit 6C provided in terminal 220 transmits a information representing the "regular program" selected by selector unit 1C as the basic program to receiver unit 7B provided in dish washer-dryer 210 over the wireless network. In other words, transmitter unit 6C transmits a basic program data (Step S75). Receiver unit 7B then receives the information representing the "regular program" transmitted by transmitter unit 6C. That is, receiver unit 7B receives the basic program data (Step S84).

Special operating program setting unit 2C provided in control panel 8D judges whether or not a change is made on any of the washing time, the number of rinse cycles and the drying time preprogrammed for the basic operating program selected by selector unit 1C (Step S76). If there is a change on the washing time, special operating program setting unit 2C corrects the washing time preprogrammed for the "regular program" chosen as the basic program according to the changed washing time. When the number of rinse cycles is changed, special operating program setting unit 2C corrects the number of rinse cycles preprogrammed for the "regular program" chosen as the basic program according to the changed number of rinse cycles. When the drying time is changed, special operating program setting unit 2C corrects the drying time preprogrammed for the "regular program" chosen as the basic program according to the changed drying time.

Next, special operating program setting unit 2C sets the specifications of the "regular program" corrected based on the basic program, as the special operating program (i.e. the "family original program"), (Step S77). Thereafter, transmitter unit 6C provided in terminal 220 transmits a information representing the specifications of the special operating program (the "family original program") established by special operating program setting unit 2C to receiver unit 7B provided in dish washer-dryer 210 through the wireless network. In other words, transmitter unit 6C transmits a setting data (Step S78). Receiver unit 7B then receives the information representing the specifications of the special operating program (the "family original program") transmitted by transmitter unit 6C. That is, receiver unit 7B receives the setting data (Step S85).

Next, when the user presses start switch 9C provided in control panel 8D (Step S79), transmitter unit 6C provided in terminal 220 transmits a information indicating that start switch 9C is pressed to receiver unit 7B provided in dish washer-dryer 210 over the wireless network. In other words, transmitter unit 6C transmits a start data (Step S80). Receiver unit 7B then receives the information indicating that start switch 9C is pressed, which is transmitted from transmitter unit 6C (Step S86).

Control unit 3B provided in dish washer-dryer 210 thus controls component drive unit 33B in a manner to carry out the washing operation, the rinsing operation and the drying operation according to the information representing the specifications of the special operating program received by receiver unit 7B in the step S85. This status is now in the state of sequential operation (Step S87). Display unit 5C provided in terminal 220 displays information indicating that dish washer-dryer 210 is in operation (Step S81).

According to the fourth exemplary embodiment, as described above, selector unit 1C provided in terminal 220 selects one of the plurality of basic operating programs, in which specifications for the washing operation, the rinsing operation and the drying operation are preprogrammed individually. The special operating program is thus established by correcting at least one of the specifications of the washing operation, the rinsing operation and the drying operation preprogrammed for one of the plurality of basic operating programs selected by selector unit 1C. Accordingly, the user can choose one basic operating program among the plurality of basic operating programs for use as the basis of establishing the special operating program. As a result, it allows the user to establish easily the desired operating specifications as the special operating program.

Figure 20:
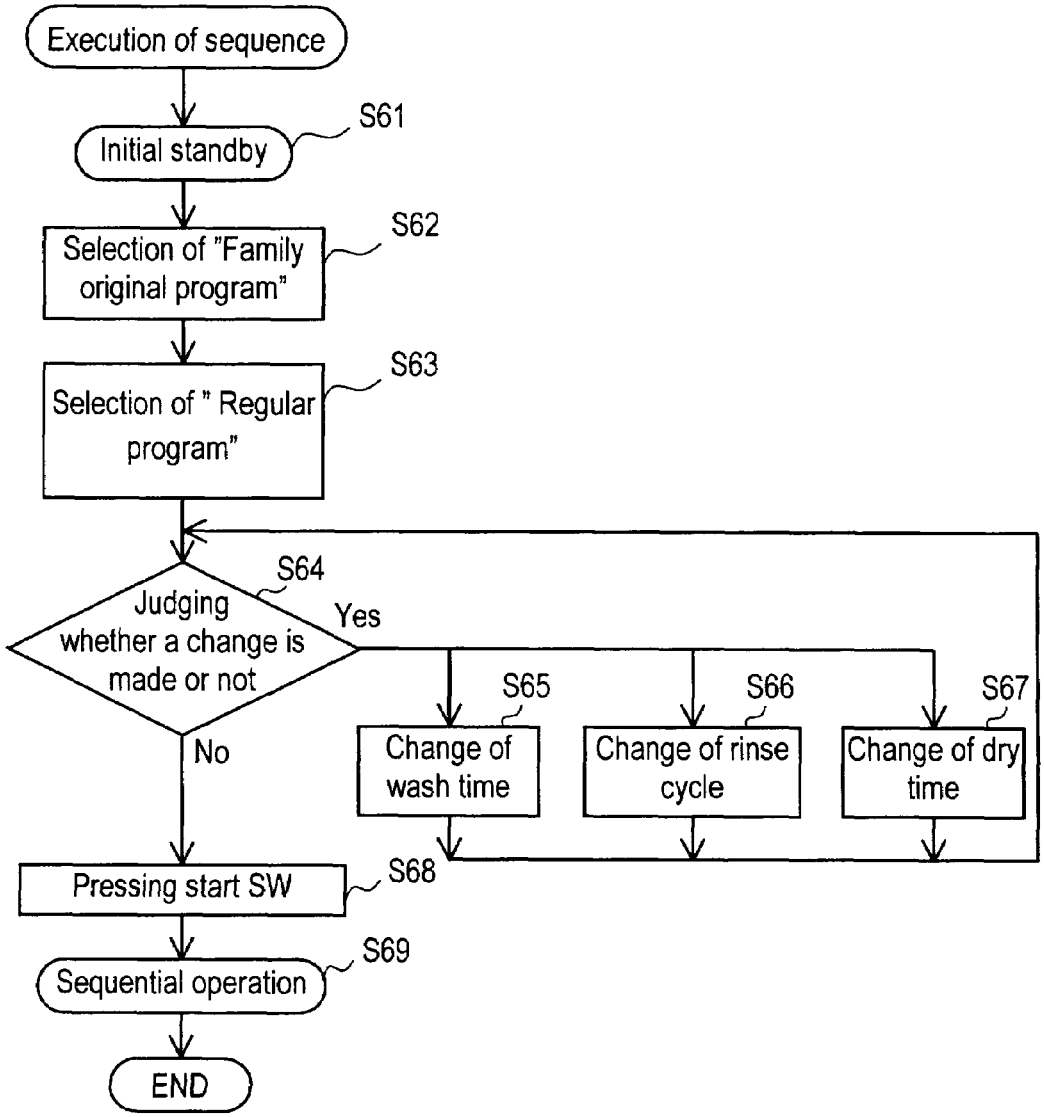
FIG. 20 is another flow chart illustrating an operation of the dish washer-dryer constituting the control system according to the fourth exemplary embodiment.
Figure 21:
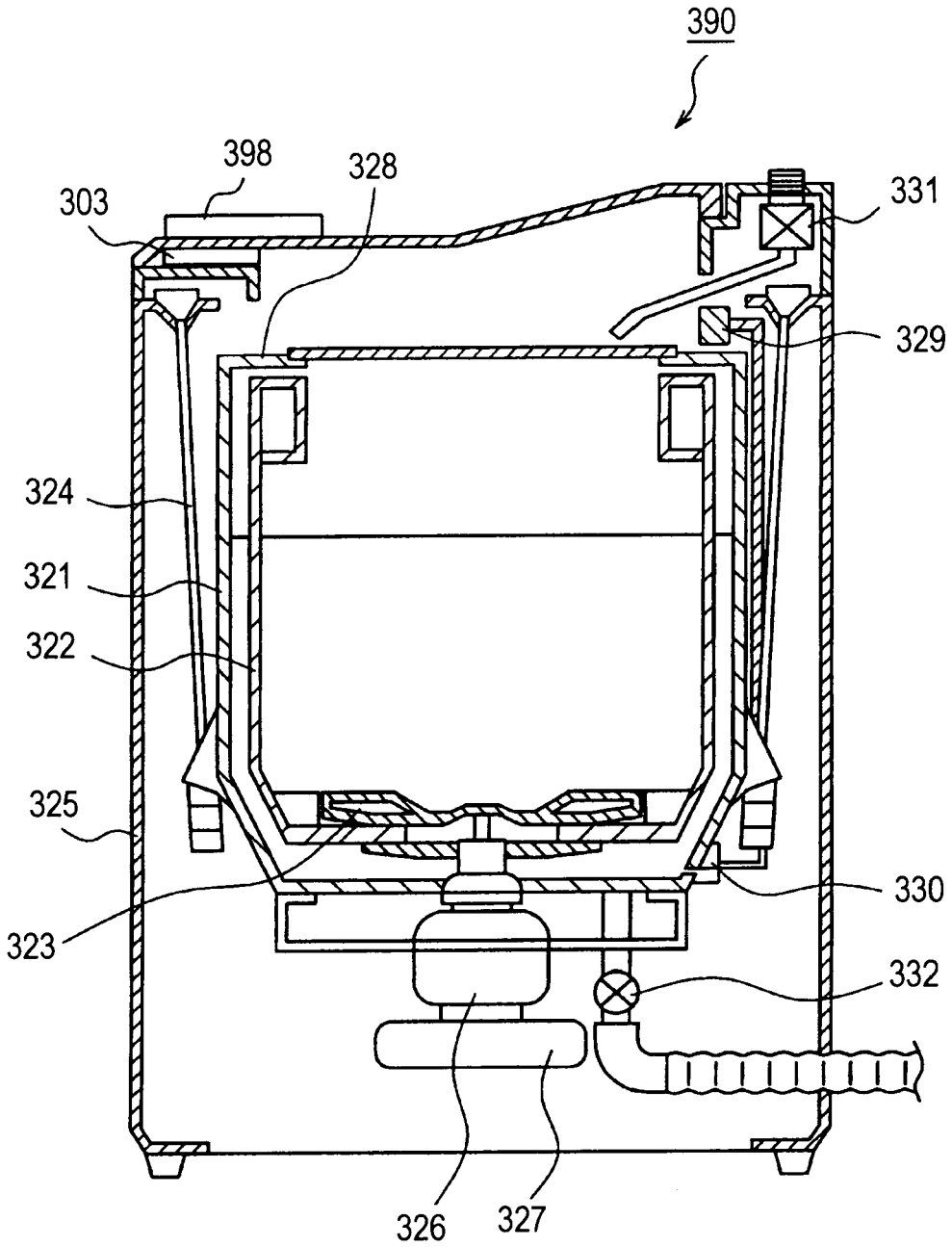
FIG. 21 PRIOR ART
FIG. 21 is a sectioned side view depicting a structure of a cloth washer of the prior art.
Figure 22:
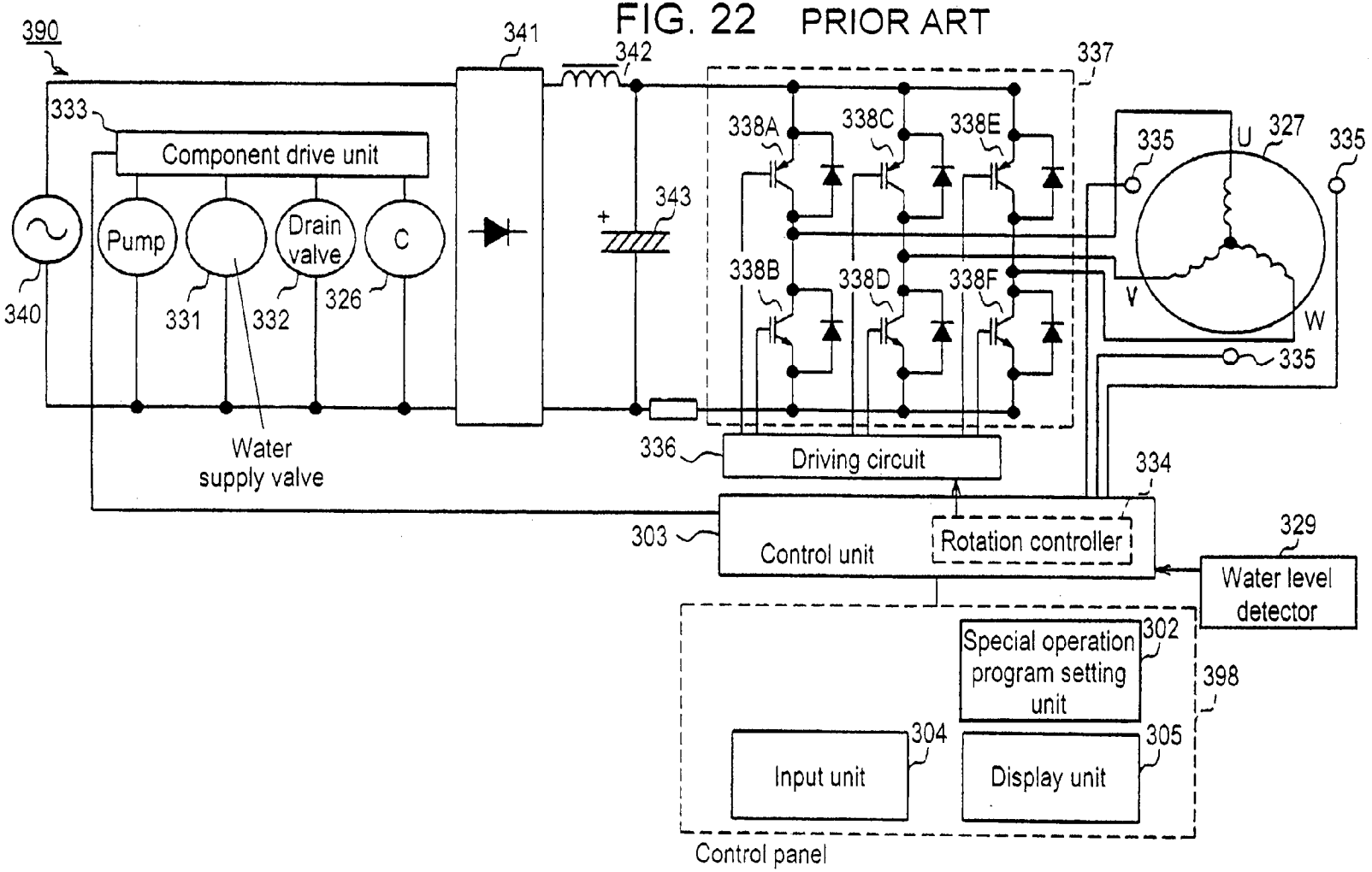
FIG. 22 PRIOR ART
FIG. 22 is a circuit block diagram depicting the structure of the cloth washer of the prior art.
Figure 23:
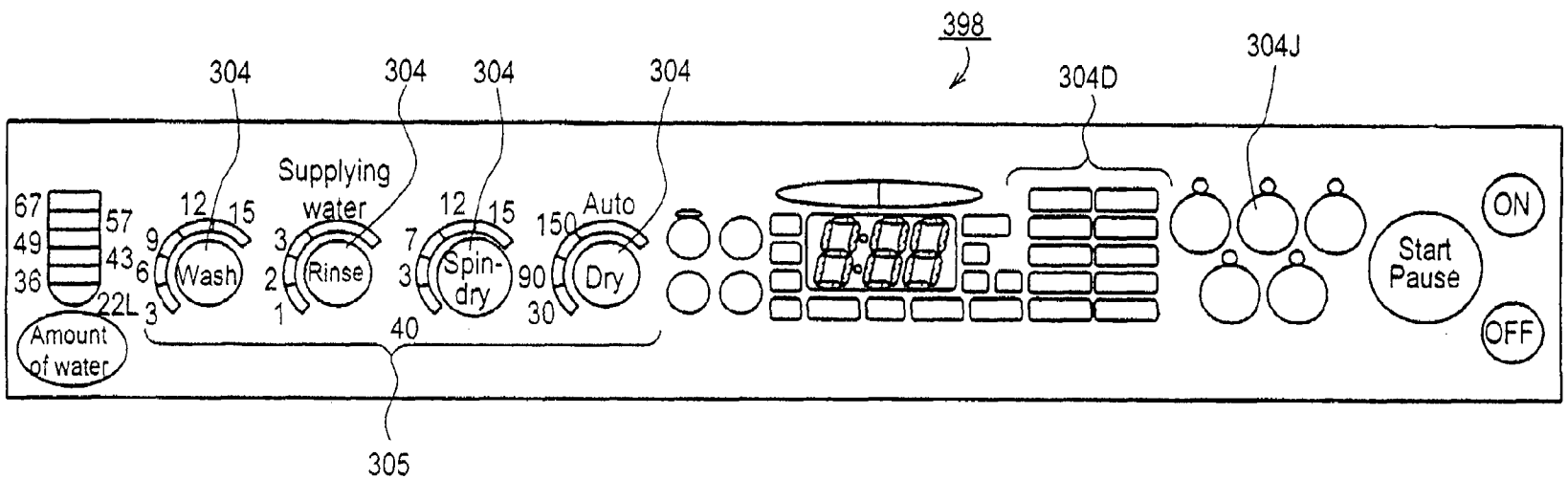
FIG. 23 PRIOR ART
FIG. 23 is a front view depicting a control panel provided in the cloth washer of the prior art.

FIG. 20 is a flow chart illustrating another operation of dish washer-dryer 210 that constitutes control system 200. First, when the user presses a power "on" switch provided on control panel 8C shown in FIG. 18, control panel 8C turns into an initial standby state (Step S61).

When the user presses special operating program selector button 4L to select the "special operating program" (i.e. the family original program) (Step S62), a plurality of buttons 4K out of those five basic operating program selector buttons 4K light up in blue color, indicating that they are the basic operating programs available for selection and for use as a basic program in establishing the special operating program. For example, two basic operating program selector buttons 4K representing the "regular program" and the "quick-wash program" light up in blue.

Next, when the user presses one of the blue-lit basic operating program selector buttons 4K for the "regular program" and the "quick-wash program", a selector unit provided in control panel 8C of dish washer-dryer 210 selects one of the basic operating programs represented by basic operating program selector button 4K pressed by the user, as a basic program. Display unit 5B then displays a washing time, a number of rinse cycles and a drying time preprogrammed for the basic operating program selected by the selector unit. Description here is provided of an example in which the "regular program" is selected as the basic program (Step S63).

A special operating program setting unit provided in control panel 8C of dish washer-dryer 210 judges whether or not a change is made on any of the washing time, the number of rinse cycles and the drying time preprogrammed for the basic operating program selected by the selector unit, as a result of information entered for the change through input unit 4M (Step S64). If there is a change on the washing time, the special operating program setting unit provided in control panel 8C of dish washer-dryer 210 corrects the washing time preprogrammed for the "regular program" chosen as the basic program according to the changed washing time (Step S65). When the number of rinse cycles is changed, the special operating program setting unit provided in control panel 8C of dish washer-dryer 210 corrects the number of rinse cycles preprogrammed for the "regular program" chosen as the basic program according to the changed number of rinse cycles (Step S66). When the drying time is changed, the special operating program setting unit corrects the drying time preprogrammed for the "regular program" chosen as the basic program according to the changed drying time (Step S67).

Next, when the user presses a start switch provided on control panel 8C of dish washer-dryer 210 (Step S68), the special operating program setting unit provided in control panel 8C of dish washer-dryer 210 establishes the special operating program (i.e. "family original program") by taking in the specifications of the "regular program" corrected as the basic program. Control unit 3B of dish washer-dryer 210 thus controls component drive unit 33B in a manner to carry out the washing operation, the rinsing operation and the drying operation according to the specifications of the special operating program set by the special operating program setting unit provided in control panel 8C of dish washer-dryer 210. The status is now in the state of sequential operation (Step S69).

According to the fourth exemplary embodiment, as described above, the selector unit provided in control panel 8C of dish washer-dryer 210 selects one of the plurality of basic operating programs, in which specifications for the washing operation, the rinsing operation and the drying operation are preprogrammed individually. The special operating program is thus established by correcting at least one of the specifications of the washing operation, the rinsing operation and the drying operation preprogrammed for the one of the plurality of basic operating programs selected by the selector unit. Accordingly, the user can choose a basic operating program among the plurality of basic operating programs for use as the basis of establishing the special operating program. As a result, it allows the user to set easily the desired operating specifications as the special operating program.

As described above, the present invention provides the cloth washer, dish washer-dryer and their control system that are capable of facilitating establishing the special operating program.

What is claimed is:

1. A cloth washer comprising:

selector means for selecting one of a plurality of basic operating programs that are preprogrammed individually with a plurality of specifications including a washing time, a number of rinse cycles and a spin-dry time, wherein at least two of the plurality of specifications are each independently settable;

special operating program setting means for establishing a special operating programs, wherein the special operating program is established by selecting one of the plurality of basic operating programs and independently setting at least two of the specifications of said washing time, said number of rinse cycles and said spin-dry time preprogrammed for said basic operating program; and control means for controlling said washing time, said number of rinse cycles and said spin-dry time according to said special operating program established by said special operating program setting means.

2. The cloth washer according to claim 1, wherein said selector means is capable of selecting a predetermined one of said plurality of basic operating programs.

3. The cloth washer according to claim 1 further comprising input means for accepting entry of selection information for selecting one of said plurality of basic operating programs.

4. The cloth washer according to claim 3, wherein said input means comprises a touch-sensitive panel.

5. The cloth washer according to claim 1 further comprising input means for accepting entry of correction information for correcting at least one of the specifications of said washing time, said number of rinse cycles and said spin-dry time preprogrammed for said one among said plurality of basic operating programs.

6. The cloth washer according to claim 5, wherein said input means comprises a touch-sensitive panel.

7. The cloth washer according to claim 5 further comprising display means for displaying said washing time, said number of rinse cycles and said spin-dry time preprogrammed for said basic operating program and said correction information entered through said input means.

8. The cloth washer according to claim 1, wherein said specifications further comprise a strength of swirling water and a spinning speed.

9. The cloth washer according to claim 1, wherein said specifications further comprise a drying operation, and wherein said special operating program setting means establishes said special operating program by correcting at least one of the specifications of said washing time, said number of rinse cycles, said spin-dry time and said drying operation.

10. A control system comprising a cloth washer and a first terminal for controlling said cloth washer, wherein said first terminal comprises:

selector means for selecting one of a plurality of basic operating programs that are individually preprogrammed with a plurality of specifications including a washing time, a number of rinse cycles and a spin-dry time, wherein at least two of the plurality of specifications are each independently settable;

special operating program setting means for establishing a special operating program, wherein the special operating program is established by selecting one of the plurality of basic operating programs and independently setting at least two of the specifications of said washing time, said number of rinse cycles and said spin-dry time preprogrammed for said basic operating program; and transmitter means for transmitting a information representing the specifications of said special operating program established by said special operating program setting means, and further wherein said cloth washer comprises:

receiver means for receiving the information representing the specifications of said special operating program transmitted by said transmitter means provided in said first terminal; and control means for controlling said washing time, said number of rinse cycles and said spin-dry time according to the information representing the specifications of said special operating program received by said receiver means.

11. The control system according to claim 10, wherein said first terminal further comprises input means for accepting entry of selection information for selecting one of said plurality of basic operating programs.

12. The control system according to claim 11, wherein said unput means comprises a touch-sensitive panel.

13. The control system according to claim 10, wherein said first terminal further comprises an input means for accepting entry of correction information for correcting at least one of the specifications of said washing time, said number of rinse cycles and said spin-dry time preprogrammed for said one among said plurality of basic operating programs.

14. The control system according to claim 13, wherein said input means comprises a touch-sensitive panel.

15. The control system according to claim 10, wherein said plurality of basic operating programs are further preprogrammed individually with the specification of a drying operation, and wherein said special operating program setting means establishes said special operating program by independently setting at least one of the specifications of said washing time, said number of rinse cycles, said spin-dry time and said drying operation.

16. The control system according to claim 10 further comprising a network for connecting between said transmitter means and said receiver means.

17. The control system according to claim 16, wherein said network comprises a wireless network.

18. The control system according to claim 10, wherein said transmitter means and said receiver means makes a communication of the information representing the specifications of said special operating program based on the ECHONET Standard.

19. A dish washer-dryer comprising:

selector means for selecting one of a plurality of basic operating programs that are individually preprogrammed with a plurality of specifications including a washing time, a rinsing time and a drying time, wherein at least two of the plurality of specifications are each independently settable;

special operating program setting means for establishing a special operating program, wherein the special operating program is established by selecting one of the plurality of basic operating programs and independently setting at least two of the specifications of the washing time, the rinsing time and the drying time preprogrammed for said basic operating program; and control means for controlling said washing time, said rinsing time and said drying time according to said special operating program established by said special operating program setting means.

20. A control system comprising a dish washer-dryer and a second terminal for controlling said dish washer-dryer, wherein said second terminal comprises:

selector means for selecting one of a plurality of basic operating programs that are individually preprogrammed with specifications including at least one of a washing time, a rinsing time and drying time to be performed by said dish washer-dryer, wherein at least two of the plurality of specifications are each independently settable;

special operating program setting means for establishing a special operating programs, wherein the special operating program is established by selecting one of the plurality of basic operating programs and independently setting at least two of the specifications of said washing time, said rinsing time and said drying time preprogrammed for said basic operating programs; and transmitter means for transmitting a information representing the specifications of said special operating program established by said special operating program setting means, and further wherein said dish washer-dryer comprises:

receiver means for receiving the information representing the specifications of said special operating program transmitted by said transmitter means provided in said second terminal; and control means for controlling said washing time, said rinsing time and said drying time according to the information representing the specifications of said special operating program received by said receiver means.

* * * * *

UNITED STATES PATENT AND TRADEMARK OFFICE

CERTIFICATE OF CORRECTION

PATENT NO. : 7,216,514 B2
APPLICATION NO. : 10/655360
DATED : May 15, 2007
INVENTOR(S) : Yoshiaki Sakita et al.

It is certified that error appears in the above-identified patent and that said Letters Patent is hereby corrected as shown below:

Column 21
Line 58, change “programs” to -- program --

Signed and Sealed this

Ninth Day of October, 2007

JON W. DUDAS
*Director of the United States Patent and Trademark Office*